US009523215B2

(12) United States Patent
Denison et al.

(10) Patent No.: US 9,523,215 B2
(45) Date of Patent: Dec. 20, 2016

(54) ELECTRONIC LOCKING SYSTEMS FOR VENDING MACHINES AND THE LIKE

(75) Inventors: William D. Denison, North Barrington, IL (US); Calin Roatis, Long Grove, IL (US)

(73) Assignee: TRITEQ LOCK AND SECURITY, LLC, Elk Grove Village, IL (US)

( * ) Notice: Subject to any disclaimer, the term of this patent is extended or adjusted under 35 U.S.C. 154(b) by 0 days.

(21) Appl. No.: 12/827,345

(22) Filed: Jun. 30, 2010

(65) Prior Publication Data

US 2010/0264677 A1 Oct. 21, 2010

Related U.S. Application Data

(63) Continuation-in-part of application No. 11/386,928, filed on Mar. 22, 2006, now Pat. No. 9,260,886, which is a continuation-in-part of application No. 10/905,524, filed on Jan. 7, 2005, now abandoned, which is a continuation of application No. 10/345,864, filed on Jan. 16, 2003, now Pat. No. 6,874,828, which is a continuation of application No. 09/962,508, filed on Sep. 25, 2001, now Pat. No. 6,581,986.

(60) Provisional application No. 60/252,210, filed on Nov. 21, 2000.

(51) Int. Cl.

| | |
|---|---|
| ***E05B 15/02*** | (2006.01) |
| ***E05B 17/00*** | (2006.01) |
| ***E05B 47/00*** | (2006.01) |
| ***E05B 63/00*** | (2006.01) |
| *E05C 3/06* | (2006.01) |

(52) U.S. Cl.

CPC ..... *E05B 17/0029* (2013.01); *E05B 47/0012* (2013.01); *E05B 63/0052* (2013.01); *E05B 15/0205* (2013.01); *E05B 2047/0017* (2013.01); *E05B 2047/0024* (2013.01); *E05B 2047/0069* (2013.01); *E05B 2047/0094* (2013.01); *Y10T 292/699* (2015.04)

(58) Field of Classification Search

CPC ..... E05B 17/0029; E05B 47/0012; E05B 63/0052

USPC ..... 292/341.16, 144, 201; 70/375

See application file for complete search history.

(56) References Cited

U.S. PATENT DOCUMENTS

| | | | |
|---|---|---|---|
| 1,875,768 | A | 9/1932 | Smith |
| 1,907,625 | A | 5/1933 | Vogt |
| 2,269,264 | A | 1/1942 | Haim |
| 2,703,431 | A | 3/1955 | Tatom |
| 2,741,503 | A | 4/1956 | Thompson |
| 2,753,202 | A | 7/1956 | Smith et al. |
| 2,833,536 | A | 5/1958 | Joachim et al. |
| 2,877,637 | A | 3/1959 | Greenwald |
| 2,896,990 | A | 7/1959 | Garvey et al. |
| 2,903,288 | A | 9/1959 | Joachim et al. |
| 2,943,880 | A | 7/1960 | Joachim et al. |
| 2,978,266 | A | 4/1961 | Poe |
| 3,080,633 | A | 3/1963 | Reddy |

(Continued)

FOREIGN PATENT DOCUMENTS

| | | |
|---|---|---|
| JP | 02-091371 | 3/1990 |

*Primary Examiner* — Kristina Fulton
*Assistant Examiner* — Faria Ahmad
(74) *Attorney, Agent, or Firm* — Miller, Matthias & Hull LLP

(57) ABSTRACT

An electronic locking system for vending machines or the like is provided for locking and unlocking the machine preferably with a remotely controlled electronic operating device.

12 Claims, 30 Drawing Sheets

(56) References Cited

U.S. PATENT DOCUMENTS 3,081,078 A * 3/1963 Lohr ..... 49/139
3,089,330 A 5/1963 Kerr
3,200,623 A 8/1965 Peters
3,550,412 A 12/1970 Pitel et al.
3,594,876 A 7/1971 Gunther
3,688,352 A 9/1972 Gunther
3,835,678 A 9/1974 Meyer et al.
3,854,310 A * 12/1974 Paull ..... E05B 47/0012 292/201
3,947,060 A * 3/1976 Zimmer ..... E05B 47/0012 292/142
4,126,341 A * 11/1978 Bradstock ..... E05B 47/0012 292/201
4,159,138 A 6/1979 Smith
4,167,104 A 9/1979 Bond
4,213,230 A 7/1980 Hoen
4,227,723 A 10/1980 Rosell
4,268,076 A 5/1981 Itoi
4,300,664 A 11/1981 Helm et al.
4,355,830 A 10/1982 Rau, III
4,411,544 A 10/1983 Gallman
4,552,001 A 11/1985 Roop
4,556,244 A 12/1985 Bisbing
4,583,775 A 4/1986 Bisbing
4,594,637 A 6/1986 Falk
4,609,215 A 9/1986 Self et al.
4,671,547 A 6/1987 Weinerman et al.
4,685,709 A 8/1987 Kambic
4,744,392 A 5/1988 Tade et al.
4,760,721 A 8/1988 Steinbach
4,762,348 A * 8/1988 Matsumoto ..... E05B 81/06 292/201
4,796,932 A * 1/1989 Tame ..... E05B 81/20 292/112
4,803,460 A 2/1989 Rhee et al.
4,819,983 A 4/1989 Alexander et al.
4,842,313 A 6/1989 Boyko et al.
4,851,742 A * 7/1989 Chapman ..... E05B 81/22 292/201
4,866,955 A * 9/1989 Blair ..... D06F 37/42 200/61.64
4,880,263 A * 11/1989 Yamada ..... E05B 85/02 200/61.62
4,892,340 A * 1/1990 Matumoto ..... E05B 81/20 292/201
4,899,561 A 2/1990 Myers
4,906,035 A 3/1990 Nagai et al.
4,917,022 A 4/1990 Ogasawara et al.
4,951,979 A * 8/1990 Escaravage ..... E05B 81/20 292/110
4,968,074 A * 11/1990 Yamagishi ..... E05B 81/20 292/201
4,993,247 A 2/1991 Minemura
5,035,452 A 7/1991 Rogers
5,054,300 A 10/1991 Nakahara et al.
5,106,251 A 4/1992 Steinbach
5,148,691 A 9/1992 Wallden
5,160,180 A 11/1992 Mlynarczyk
5,186,516 A 2/1993 Alexander et al.
5,199,288 A 4/1993 Merilainen et al.
5,269,161 A 12/1993 Stillwagon
5,272,894 A 12/1993 Stillwagon et al.
5,288,115 A * 2/1994 Inoue ..... E05B 81/20 292/201
5,349,345 A 9/1994 Vanderschel
5,394,718 A * 3/1995 Hotzl ..... E05B 47/0012 292/144
5,467,619 A 11/1995 Stillwagon et al.
5,548,982 A 8/1996 Rawling
5,575,515 A 11/1996 Iwamoto et al.
5,617,082 A 4/1997 Denison et al.
5,618,082 A 4/1997 Jachmich
5,636,881 A 6/1997 Stillwagon
5,639,130 A 6/1997 Rogers, Jr. et al.
5,656,867 A 8/1997 Kokubu
5,656,899 A * 8/1997 Kuroda ..... E05B 81/06 292/201
5,680,783 A 10/1997 Kuroda et al.
5,713,613 A * 2/1998 Honma ..... E05B 77/48 292/201
5,762,384 A * 6/1998 Bartel ..... E05B 77/48 292/201
5,791,179 A * 8/1998 Brask ..... E05B 13/004 292/142
5,793,122 A 8/1998 Dingwall
5,802,894 A * 9/1998 Jahrsetz ..... E05B 77/48 292/144
5,813,257 A * 9/1998 Claghorn et al. ..... 70/208
5,823,027 A 10/1998 Glick et al.
5,862,693 A 1/1999 Myers et al.
5,915,766 A 6/1999 Baumeister et al.
5,921,119 A 7/1999 Myers et al.
5,944,367 A * 8/1999 Imaizumi ..... E05B 81/06 292/201
6,005,487 A 12/1999 Myers et al.
6,046,681 A 4/2000 Solop
6,049,287 A * 4/2000 Yulkowski ..... 340/693.12
6,068,305 A * 5/2000 Myers ..... E05B 17/0029 292/201
6,068,308 A 5/2000 Molzer
6,068,487 A 5/2000 Dionne
6,106,035 A 8/2000 Hetherington
6,130,611 A 10/2000 Pellaton et al.
6,196,037 B1 3/2001 Urschel et al.
6,256,932 B1 * 7/2001 Jyawook ..... E05B 77/24 292/336.3
6,341,448 B1 1/2002 Murray et al.
6,345,522 B1 2/2002 Stillwagon et al.
6,360,573 B1 3/2002 Ming-Chih
6,370,928 B1 4/2002 Chies et al.
6,374,649 B1 * 4/2002 Holcomb ..... E05B 65/468 312/215
6,406,071 B1 6/2002 La Viola et al.
6,474,119 B1 11/2002 Halvorson et al.
6,496,101 B1 12/2002 Stillwagon
6,525,644 B1 2/2003 Stillwagon
6,543,264 B2 4/2003 Frolov
6,564,600 B1 * 5/2003 Davis ..... E05B 47/0669 70/277
6,575,504 B2 * 6/2003 Roatis ..... E05B 17/0029 292/199
6,580,355 B1 6/2003 Milo
6,581,986 B2 6/2003 Roatis et al.
6,684,671 B2 * 2/2004 Beylotte et al. ..... 70/208
6,729,663 B2 * 5/2004 Fisher ..... E05B 81/16 292/201
6,867,685 B1 3/2005 Stillwagon
6,874,828 B2 4/2005 Roatis et al.
7,073,827 B2 * 7/2006 Cherry ..... E05B 17/0033 292/144
7,137,387 B2 * 11/2006 Edwards ..... F24C 15/022 126/190
7,191,624 B2 * 3/2007 Beylotte et al. ..... 70/257
8,967,680 B2 * 3/2015 Yokomori ..... B60J 5/00 292/201
9,260,886 B2 * 2/2016 Myers ..... E05B 17/0029
2003/0127866 A1 * 7/2003 Martinez ..... E05B 17/0029 292/216
2004/0154363 A1 8/2004 Beylotte et al.
2005/0161953 A1 7/2005 Roatis et al.
2006/0186678 A1 8/2006 Myers et al.
2010/0264677 A1 * 10/2010 Denison ..... E05B 17/0029 292/341.16
2011/0084506 A1 * 4/2011 Roatis ..... E05B 17/0029 292/240
2013/0104459 A1 * 5/2013 Patel ..... E05B 47/0657 49/70
2015/0137531 A1 * 5/2015 Papanikolaou ..... E05B 77/28 292/201
2015/0184433 A1 * 7/2015 Ueda ..... E05B 85/20 292/201

(56) References Cited

U.S. PATENT DOCUMENTS

| | | | | |
|---|---|---|---|---|
| 2015/0240534 | A1* | 8/2015 | Kuriyama | E05B 79/20 292/201 |
| 2016/0010364 | A1* | 1/2016 | Hanaki | E05B 77/54 292/21 |
| 2016/0145928 | A1* | 5/2016 | Shimizu | E05F 15/611 292/201 |
| 2016/0153212 | A1* | 6/2016 | Bingle | E05B 41/00 292/201 |

* cited by examiner

ELECTRONIC LOCKING SYSTEMS FOR VENDING MACHINES AND THE LIKE

RELATED APPLICATIONS

This application is a continuation-in-part of U.S. patent application Ser. No. 11/386,928, filed Mar. 22, 2006, which is a continuation-in-part of U.S. patent application Ser. No. 10/905,524, filed Jan. 7, 2005, which is a continuation of U.S. patent application Ser. No. 10/345,864, filed Jan. 16, 2003, now U.S. Pat. No. 6,874,828, incorporated herein by reference, which is a continuation of U.S. patent application Ser. No. 09/962,508, filed Sep. 25, 2001 (now U.S. Pat. No. 6,581,986), incorporated herein by reference, which is based on Disclosure Document No. 453,811, filed Mar. 26, 1999, entitled "Vending Cam Lock," incorporated herein by reference, and claims priority on U.S. Provisional Patent Application No. 60/252,210, filed Nov. 21, 2000, incorporated herein by reference. This application is also related to, and incorporates by reference, U.S. Pat. No. 6,575,504, filed Sep. 25, 2001, which descends from the aforesaid Provisional application (i.e., U.S. Provisional Patent Application Ser. No. 60/252,210).

TECHNICAL FIELD OF THE INVENTION

The present invention relates generally to locking devices and, more particularly, to a locking system for vending machines and the like and a method for locking and unlocking the same.

BACKGROUND OF THE INVENTION

In various machines such as vending machines, food machines, candy machines, refrigerated drink machines, and the like, there is ordinarily provided a lock assembly to prevent unauthorized access to the contents thereof. For example, some vending machines are provided with a key-activated lock assembly such as a pop-out T-handle lock assembly which allows an authorized user to open the door of the vending machine with a properly-encoded key. Such T-handle lock assemblies are well known in the art, as evidenced by numerous patents including U.S. Pat. No. 3,089,330 (Kerr), U.S. Pat. No. 3,550,412 (Pitel et al.), U.S. Pat. No. 4,552,001 (Roop), U.S. Pat. No. 4,760,721 (Steinbach), U.S. Pat. No. 4,899,561 (Myers), and U.S. Pat. No. 5,548,982 (Rawling). With such lock assemblies, the door is initially closed in a loose manner to catch the locking components of the lock assembly. Next, the handle of the locking assembly is rotated to draw the door against the housing of the vending machine and to compress a seal between the door and the housing. Other, more modern, vending machines are provided with a keypad-activated lock assembly which permits the door of the vending machine to be opened when a predetermined access code or combination is entered into the keypad. The prior art, however, failed to provide a lock assembly which automatically pulls the door of a vending machine into a completely closed position against the housing and/or a lock assembly which utilizes a remotely controlled electronic latching mechanism to lock and unlock the door. More recently, however, as shown in U.S. Pat. No. 6,068,305 (Myers et al.) such a locking system was proposed. Further refinements, improvements and better, different and improved locking components and systems have been sought by users and manufacturers of the machines.

The now most commercially accepted electronic locking system marketed by applicants' assignee TriTeq Lock and Security, LLC. is disclosed and claimed in its aforementioned U.S. Pat. Nos. 6,874,828, 6,581,986, 6,575,504 and pending application Pub. No. US 2005/0161953. There, a motor driven bayonet locking system has a bayonet locking element that moves both in the transational and rotational axis and coacts with a stationary slotted plate by extending to enter the plate, rotating to create an interferance from being withdrawn and then retracting to pull in and lock the door.

Other approaches both prior and later which are not believed to have become commercially acceptable sought to employ different types of mechanical latches and undirectionally actions electronic drivers such as solenoids.

Bond U.S. Pat. No. 4,167,104 proposed use of screw posts going into a threaded opening with a solenoid operating latching bolt. Similarly, Stillwagon U.S. Pat. Nos. 6,867,685 and 6,525,644 did the same with a notched post latch.

Martinez Publication US 2003/0127866 proposes a motor driven rotary hook and u-bolt where the hook shape provides pull in cam action.

Beylotte et al. Pub. No. US 2004/0154363 sought to motor drive a threaded post into a threaded split nut as in prior mechanically operated T-handle vending machine locks. Beylotte et al. who proposed a motor driven cam hook an alternative embodiment.

U.S. patent to Myers et al. (U.S. Pat. No. 6,068,308) is an earlier form of latch with a pull in function.

OBJECTS OF THE INVENTION

Accordingly, a general object of the present invention is to provide an improved locking system capable of even being a key-less electronic operated lock for vending machines and the like.

A related object of the present invention is to provide a cam-operated or bayonet locking system and method for locking and unlocking vending machines or the like in a novel and secure manner.

An additional object of the present invention is to provide a cam-operated or bayonet locking system having the foregoing characteristics which is more reliable, durable, economical and convenient to use.

SUMMARY OF THE INVENTION

An electro-mechanical cam-operated system having a function that facilitates specialized movements that can be utilized to secure and seal a variety of devices. The sealing action is being defined as a pulling motion of the primary mechanism. The locking action happens by virtue of a localized geometry that interfaces into an another specialized designed receiver device. The receiver device is generally mounted in a stationary manner. The localized geometrically designed element is called a cam or a bayonet for the purposes of this abstract. The cam or bayonet design is not intended to be a single geometry element that unto itself is design critical to the operation concept of this mechanism. Alternate methodology may be used to facilitate the securing portion of the mechanism.

The cam is designed to operate perpendicular to the receiver in such a manner as to allow it to enter into the receiver by allowing the cam to have geometry that allows the cam to enter into it. After this is accomplished an electrical detection device sends a signal to an electrical control device. This device then sends a signal to a motor that in turn rotates a cylindrical device located about another cam. This cylindrical device has a unique geometry that interfaces with a central located tube type of device and a tubular type pin. The combined rotation causes the other cam to first rotate 90 degrees or thereabout. And then begin to wind its way up a spiral ramp located in a pocket of the cylindrical device. This cylindrical device also has two binary electrical devices that are strategically located to detect the relative position of the locking cam for both rotation and sealing (pull). This cylindrical device has a typical gear shape located on its outside diameter. This gear movement is derived from a worm gear interface that is driven by a motor. The motor derives its intelligence from the electrical controller.

The bayonet is designed to operate tangent to the receiver in such a manner as to allow it to interlock into the receiver by allowing the bayonet to have geometry that allows the bayonet to enter into and pass behind it. After this is accomplished an electrical detection device sends a signal to an electrical control device. This device then sends a signal to a motor that in turn rotates a cylindrical device located about the bayonet. This cylindrical device has a unique geometry that interfaces with a central located tube type of device and a tubular type pin. The combined rotation causes the bayonet to first rotate 90 degrees or thereabout. And then begin to wind its way up a spiral ramp located in a pocket of the cylindrical device. This cylindrical device also has two binary electrical devices that are strategically located to detect the relative position of the bayonet for both rotation and sealing (pull). This cylindrical device has a typical gear shape located on its outside diameter. This gear movement is derived from a worm gear interface that is driven by a motor. The motor derives its intelligence from the electrical controller.

In another embodiment in accordance with the present invention, an optionally key-less electronically operated bayonet locking device and method of operating the same is provided wherein a rotatable and translatable bayonet device or means having an arrow shaped end is carried by respective ones of the vending machine door and cabinet and a stationary slotted receiving member carried by the other one of the respective door and cabinet. The bayonet device arrow shaped end enters the slotted receiving member and then rotates to secure the door and the end translates longitudinally to pull in the door for effectively sealing a door gasket on the machine. The locking device is constructed so as to enable that rotation at least in the transitional phase with longitudinal translation of the arrow shaped end occurs together.

A specific intelligence is embedded into the controller that facilitates several fault modes and operational parameter of the electromechanical system. This intelligence may be delineated as relay or software type of logic. The lock controller provides two specific functions.

Access control functions to ascertain the authorized user is accessing the locking device. Several access control methodologies may be utilized such as keypads with specific codes for entry, hand-held transceivers, electronic digital keys, transponders, etc.

Typical access control functions such as keypads, remote controls and electronic keys are taught in Denison U.S. Pat. No. 5,618,082 and Vandershel U.S. Pat. No. 5,349,345. The locking device may utilize any such access control methodology that is appropriate for the application for the operator and the enclosure the lock is mounted to.

Lock motor control functions once the controller has determined the lock is authorized to change from the locked to unlocked state, or, authorized to change from the unlocked to locked state. The components required to accomplish the required motor control operation are the motor drive, cam or bayonet, Receiver, Receiver Sensor, SW1 end of rotation sensor, SW2 30 degree Sensor, overcurrent sensor, and the CPU based controller.

The cylindrical device has a cover located about the opposite side of the area that causes the pin to wind it way on the ramp. This cover keeps the pin in a proper perpendicular path to the mechanisms securing motion.

The utilization of this device is providing simple easy access to devices that by necessity of application have a gasket or another means of sealing a door or the like. This would be described by what is common known as an automotive door. The door must be accelerated to a speed that can facilitate the compression of the gasket and then secure the door. Much like slamming of a car door. This device provides an alternate method of closing the door and pulling the gasket to a sealed condition. This device is also furthered in its invention by having methodology through electrical monitoring of the cam or bayonet conditions to adjust the pressure on the door gasket or seal. This is accommodated either by electrical position devices or detecting the motor characteristics by the electrical controller. The automotive door is used to only describe the actions, which caused the necessity of this invention. Any device that has a requirement for securing and sealing is a possible application of this device.

Applications: Truck Doors, Vending Machine Doors, Automotive Doors, Refrigerator Doors, Etc.

The cylindrical device with its associated motor and electrical detection devices are always mounted in a manner that separates them from the receiver unit. To further clarify this explanation consider the following sample concept, a car door has a rotary type securing device that is generally located in the door that secures its via a mechanical interface with a pin that is located in the frame of the vehicle. The cylindrical device would draw a similarity in its function as the rotary type device. The utility of this is to further the security by sealing the door after closing. Recalling that this device in its improvement into the market does not require massive forces to initiate the function of securing the cam or bayonet. This means that the device the system is mounted to would inherently be subject to less stress and wear, thus extending its life.

While there are mechanisms in the public domain that facilitate total system functionality of the specific motion similar to that being described here. One of the unique attributes of this product design is its ability to absorb very high closing impact forces without subjecting the system or the mechanism it is mounted to any impact damages. This system has shock absorbing devices located within the tube and positioned on the end of the cam or bayonet. Such is this geometry that it does not deter from the adjustment function as an independent local event in the motion of pulling in. The cam or bayonet in this system also serves to assist with alignment of the device it's attached to. By moving from the closed to the secure positions the cam or bayonet has geometry which considers the perpendicularity into its motion and effectively cams it into the perpendicular position.

Also the other commercial systems which have similar motion to securing and sealing do not utilize the unique rotary motion of the cam or bayonet used in this system.

This system replaces many devices in the public domain. Systems such a handles for vending machines. This system is designed to operate within the structure of the device it is securing. Therefore there is not external means by which to attack it. It may operate via an electrical controller that can utilize a variety of communication methods that are commercially available. These include but are not limited to Infrared, Radio frequency, and Switch keylock.

Because this design requires the application of an electrical signal to the motor to activate the system for both securing and opening sequence These activities can be monitored for later data collection. This data collection can be facilitated in many methodologies. This data then can serve the operator or owner for the purposes of detecting what key was used to gain access to the system.

One methodology which is being claimed that is unique to this design is the ability to monitor the data through acquisition of the data with the remote initialization device. Typically known as a key, Key FOB of remote control. While this data collection is not primary to the system function. It acts to enhance the product to the market place.

US Reference:

U.S. Pat. No. 6,068,305 Fort Lock

U.S. Pat. No. 4,993,247 Sampo Lock

U.S. Pat. No. 5,272,894 Star Lock

Fort Lock U.S. Pat. No. 6,068,305 shows a type of system that pulls in. The pulling forces are transmitted through a rotor type latch. This system differs in that it uses a local designed bayonet that interfaces with a special receiver unit. Sampo U.S. Pat. No. 4,993,247 cites a slip nut arrangement. And U.S. Pat. No. 5,272,894 Star lock shows a retrofit design that eliminates the lazy action but still require manual input.

BRIEF DESCRIPTION OF THE SEVERAL VIEWS OF THE DRAWING(S)

Figure 5B:
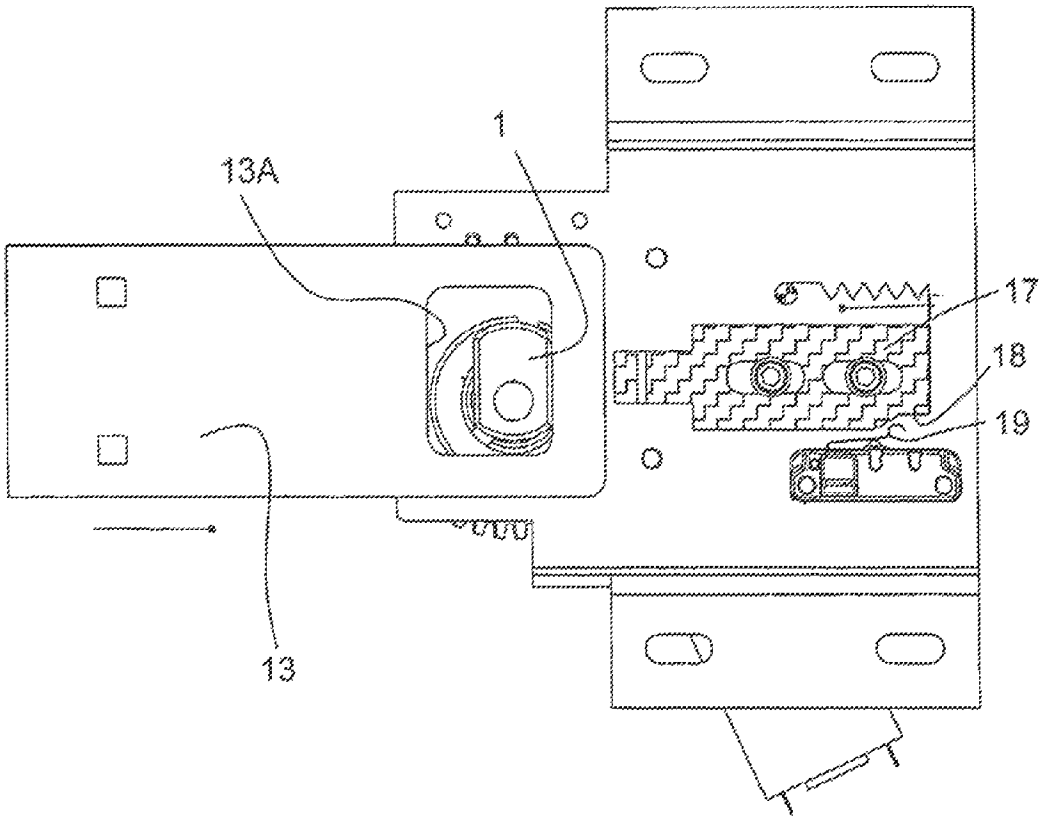
Figure 5A:
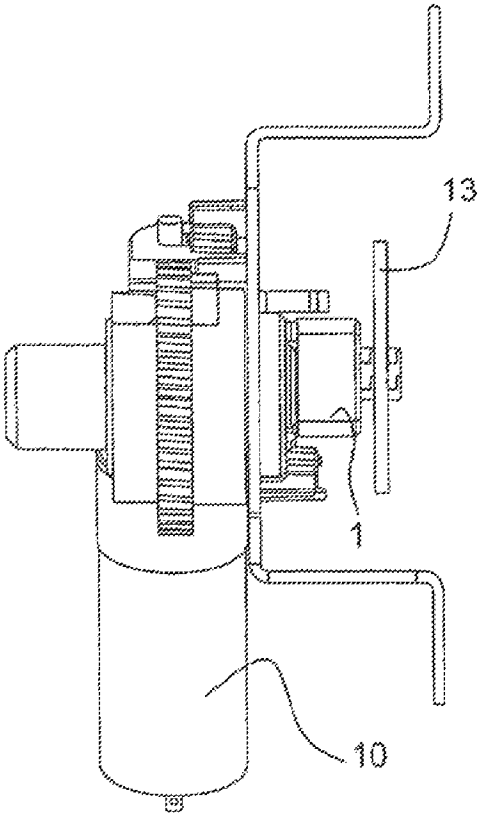
Figure 6B:
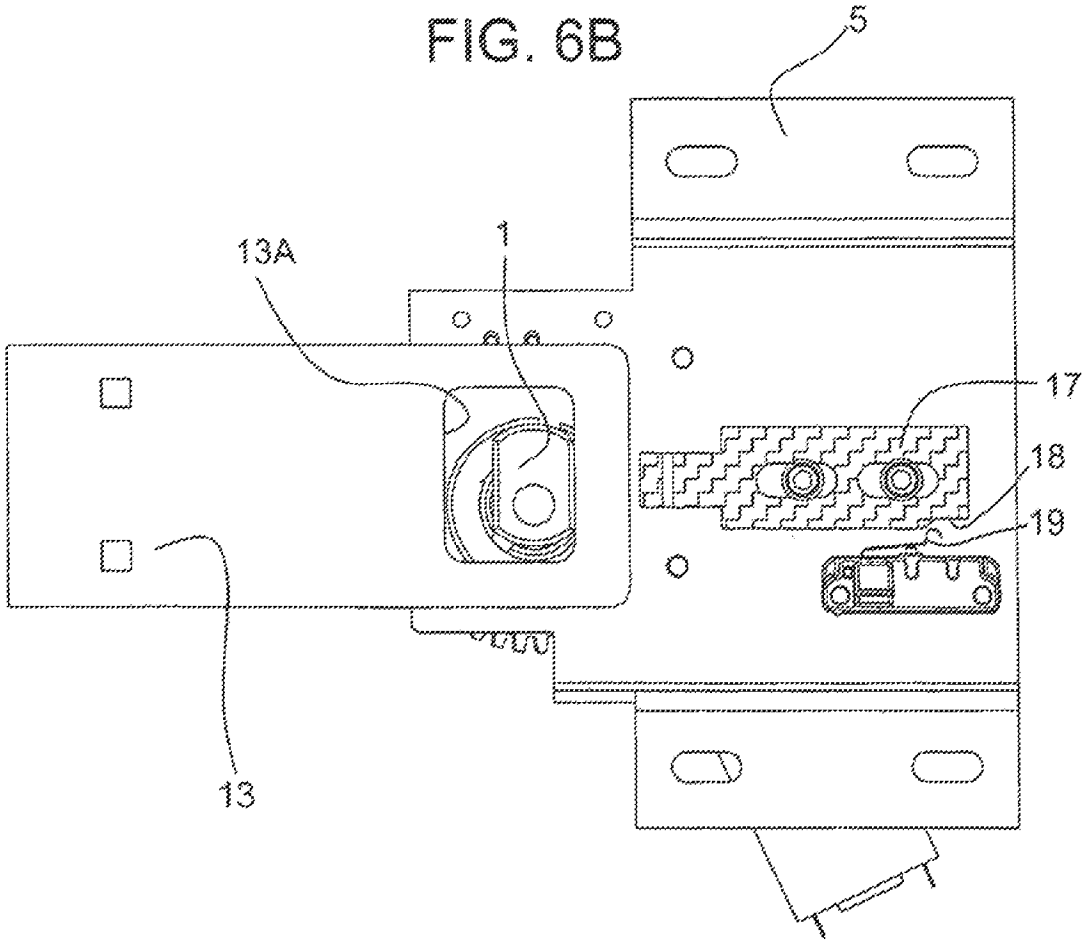
Figure 6A:
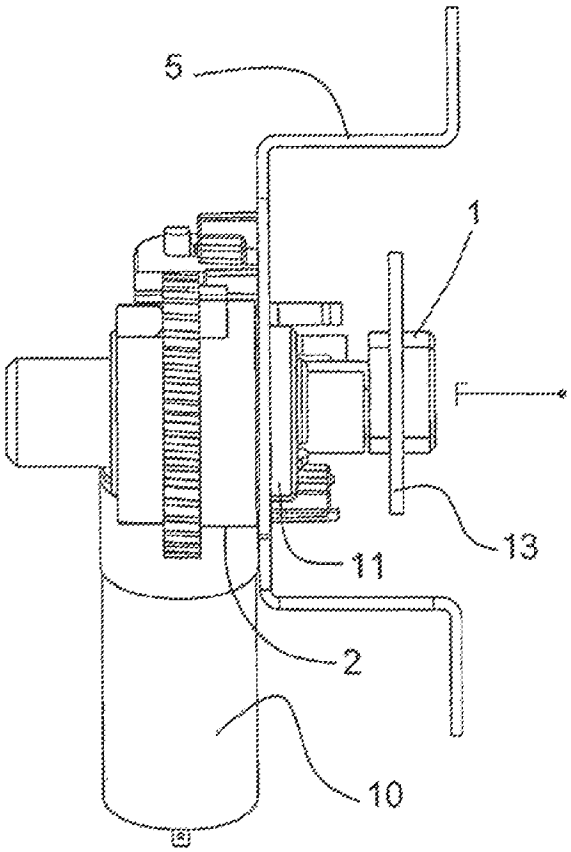
Figure 7B:
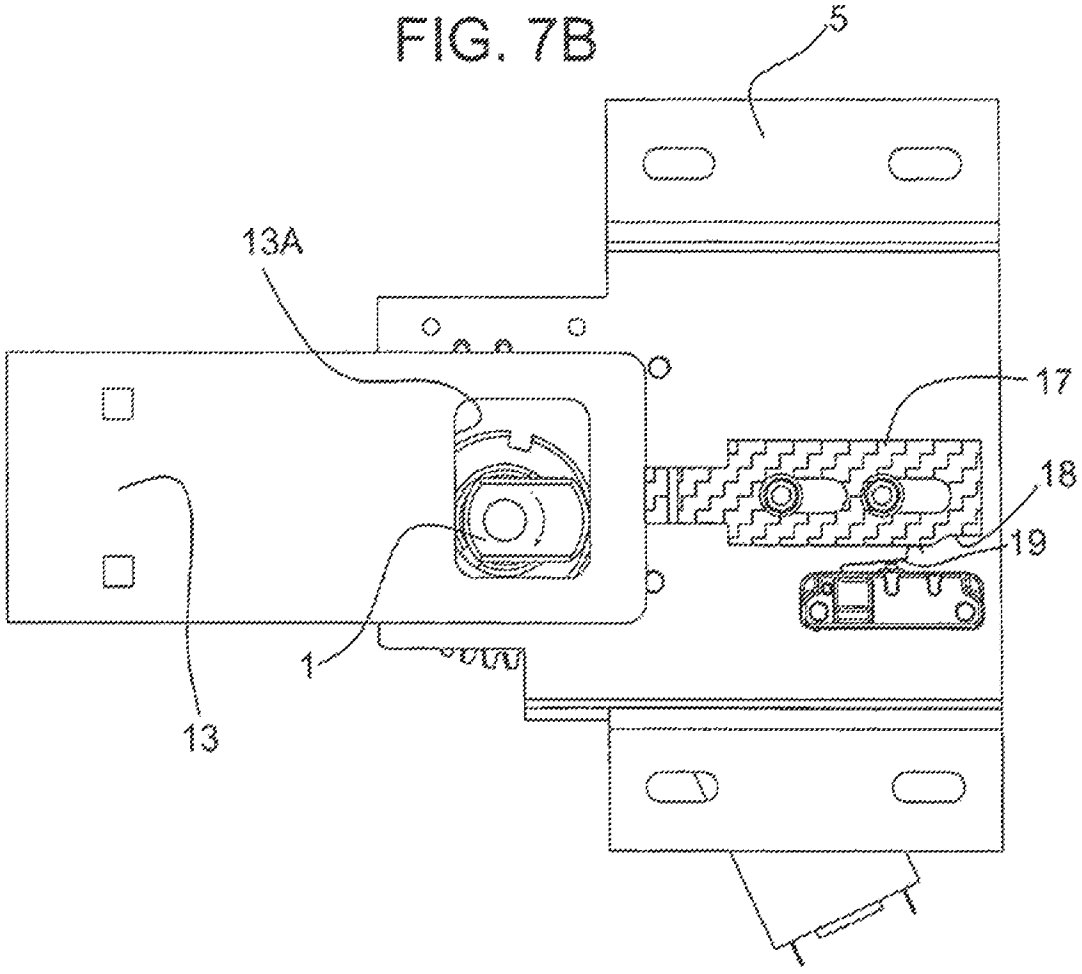
Figure 7A:
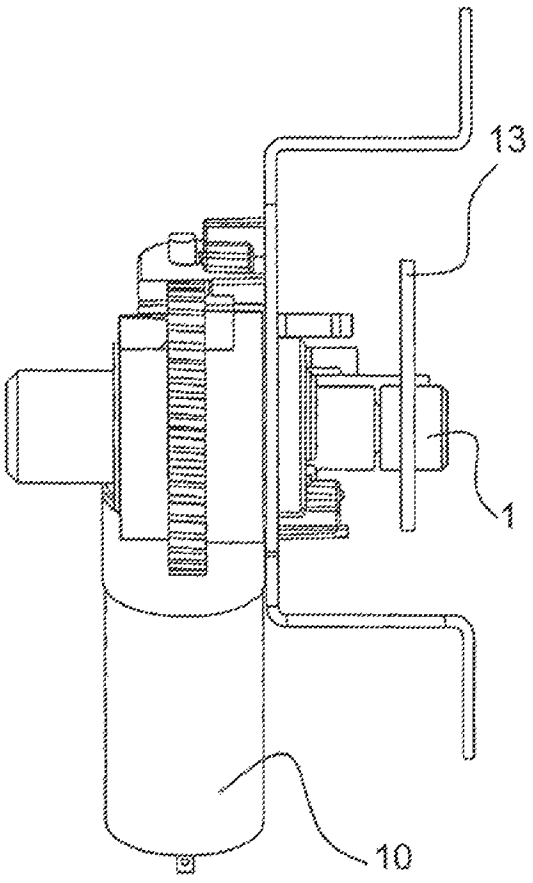
Figure 8B:
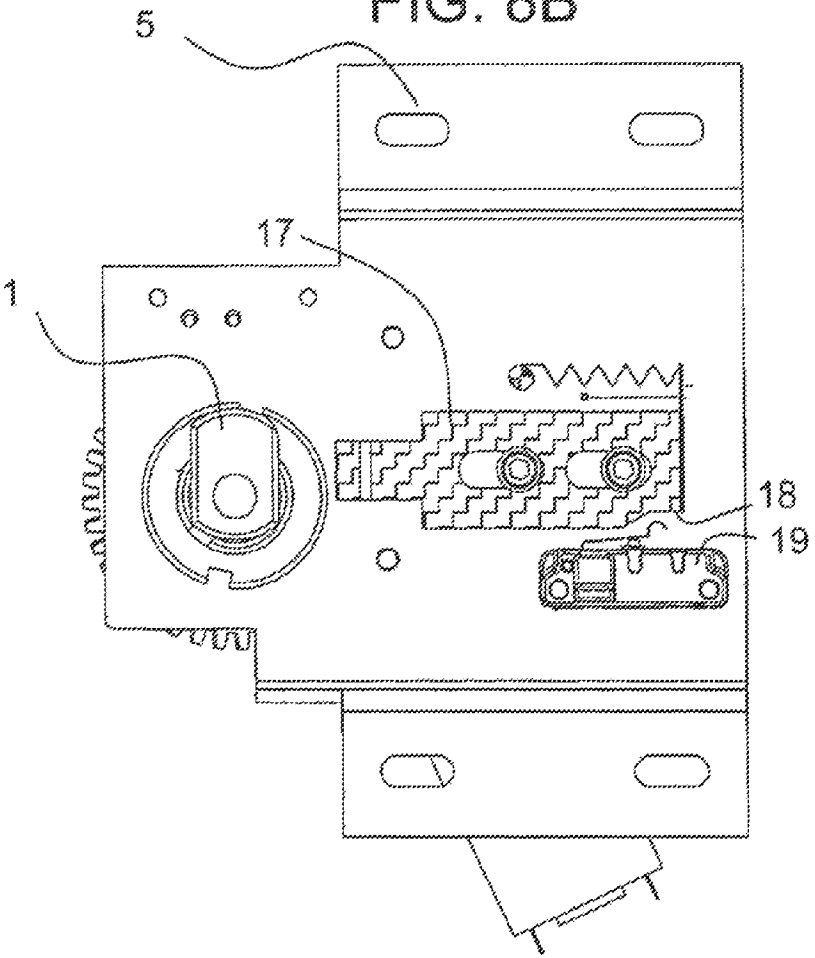
Figure 8A:
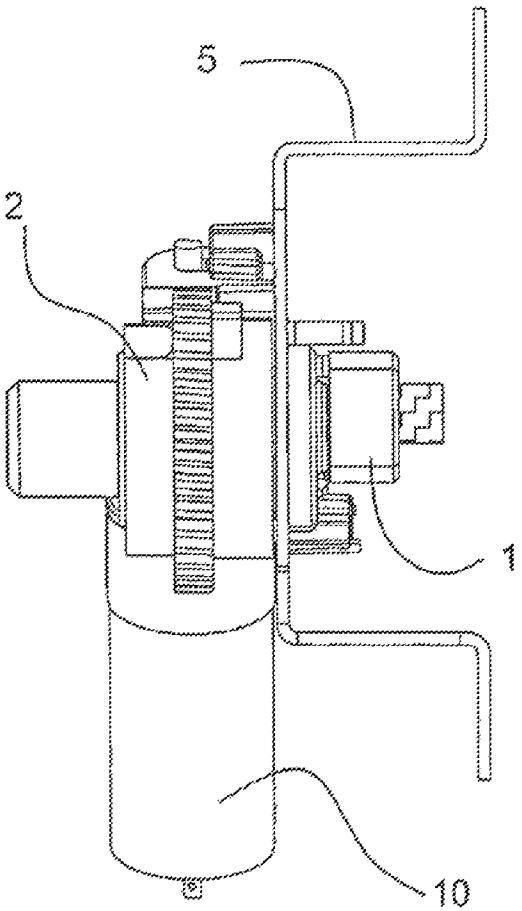
Figure 9B:
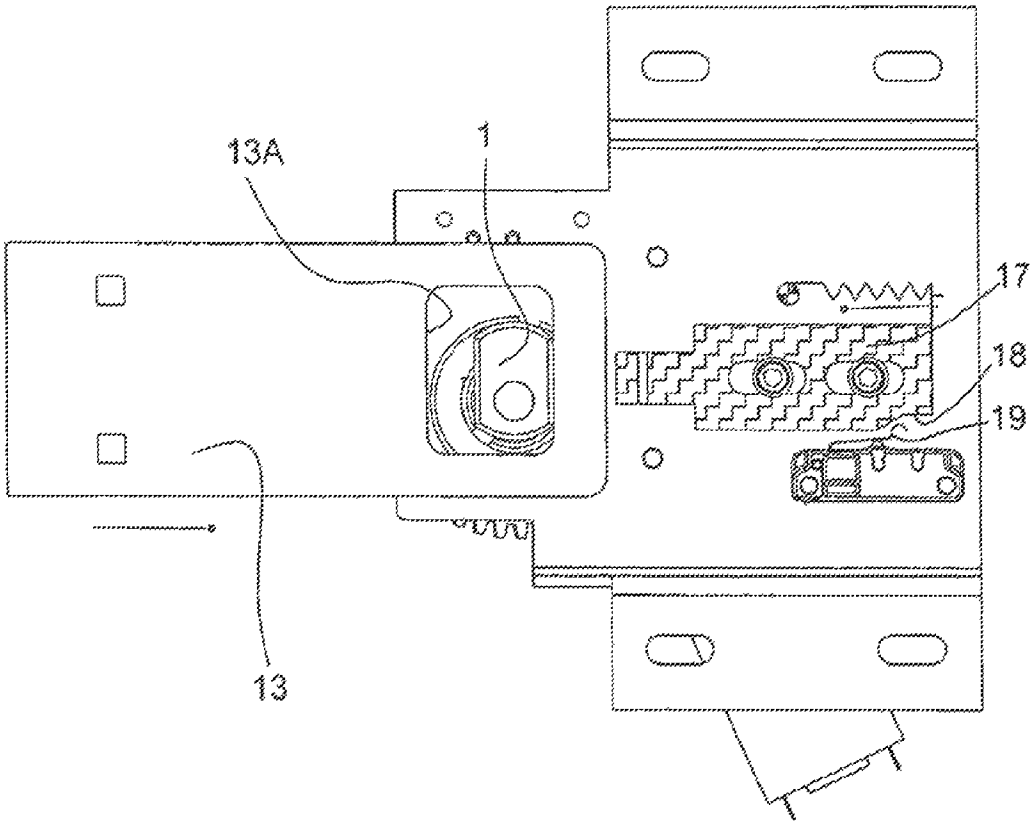
Figure 9A:
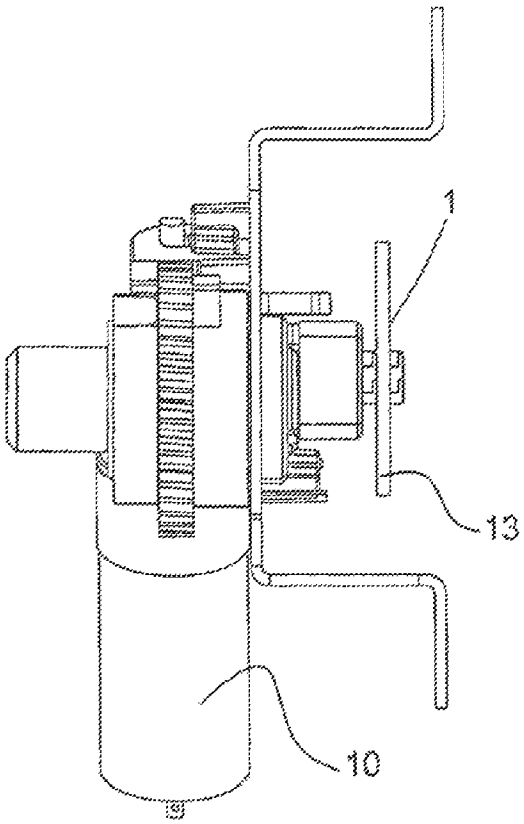
Figure 11:
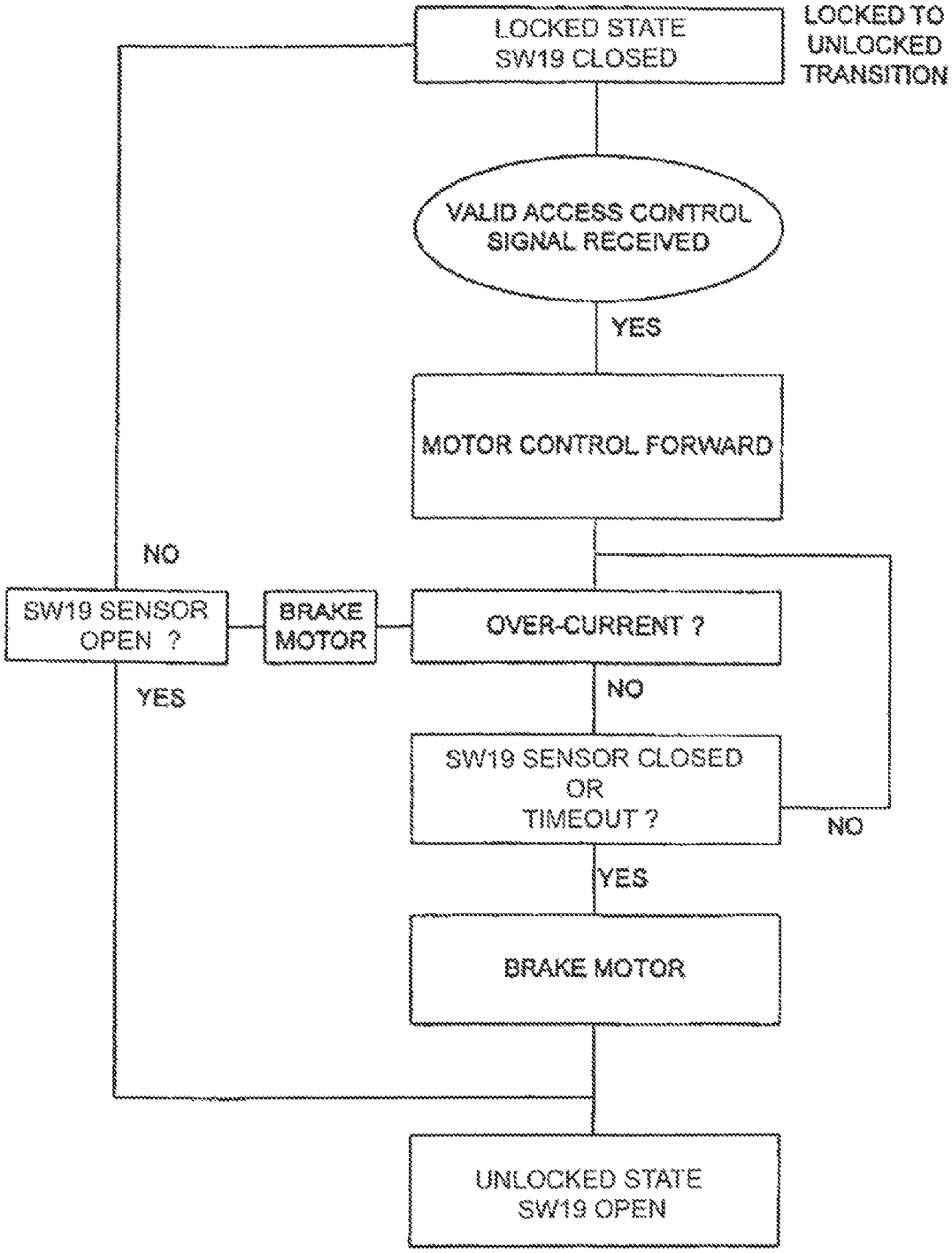
Figure 12:
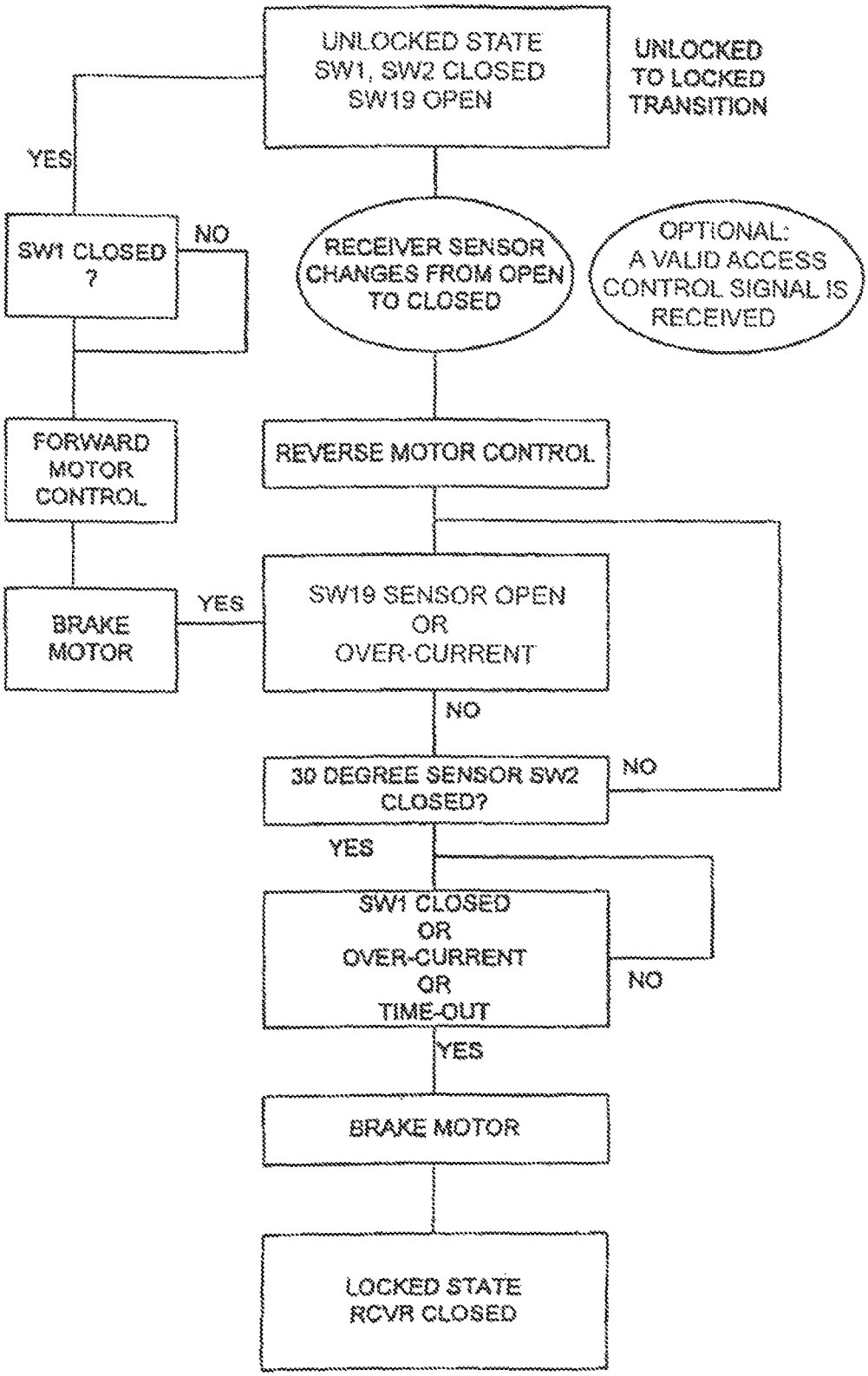
Figure 13:
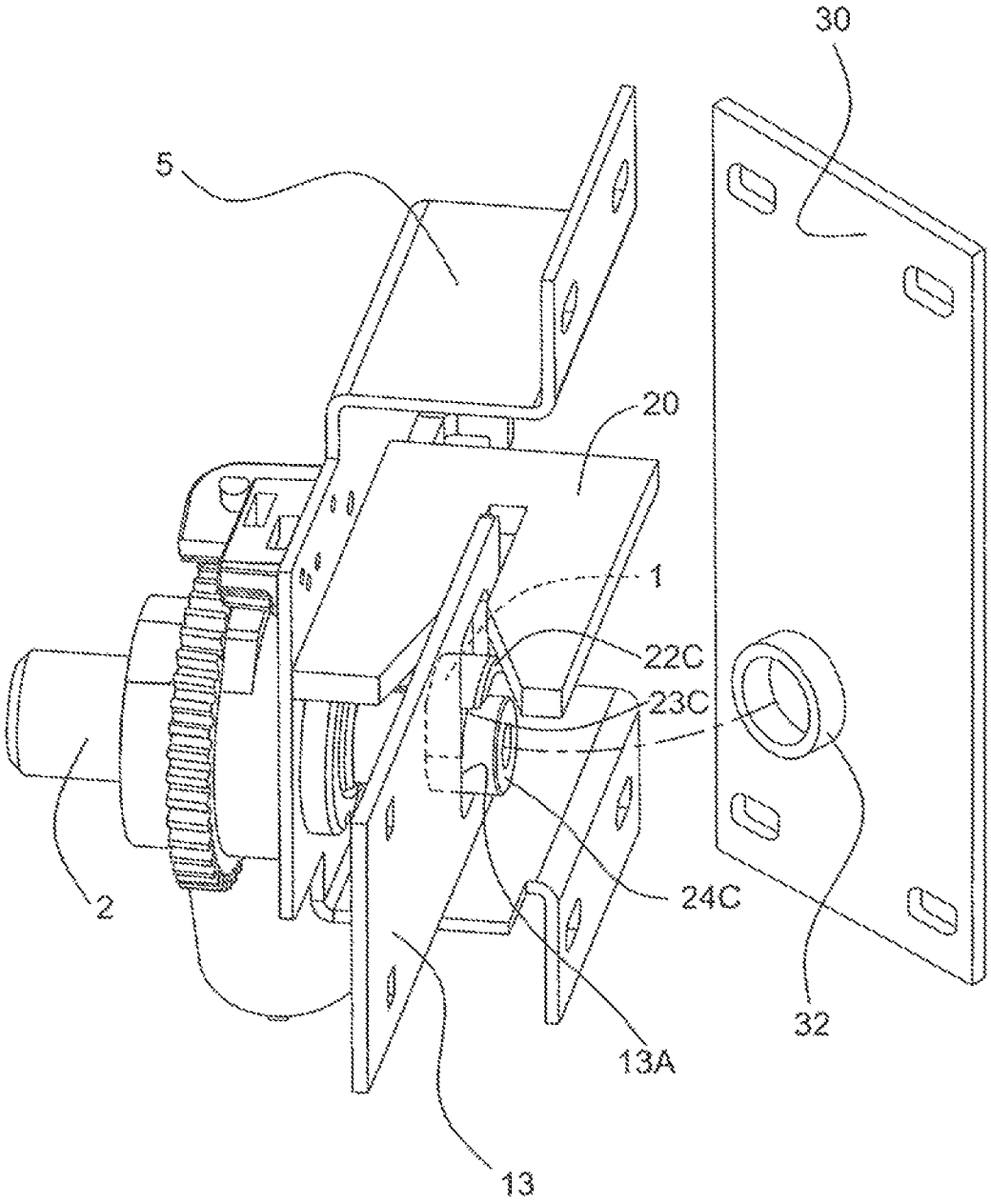
Figure 14:
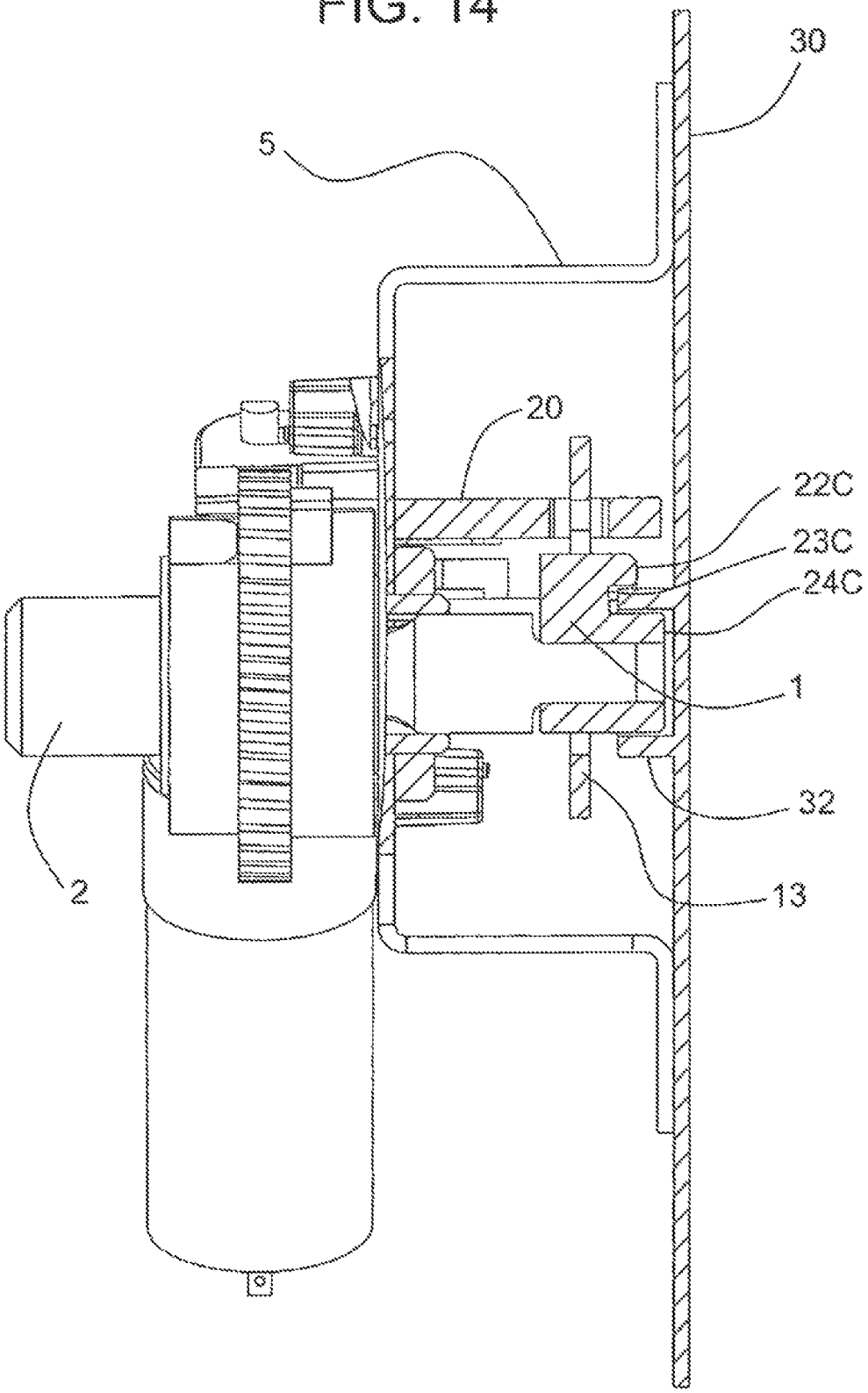
Figure 15:
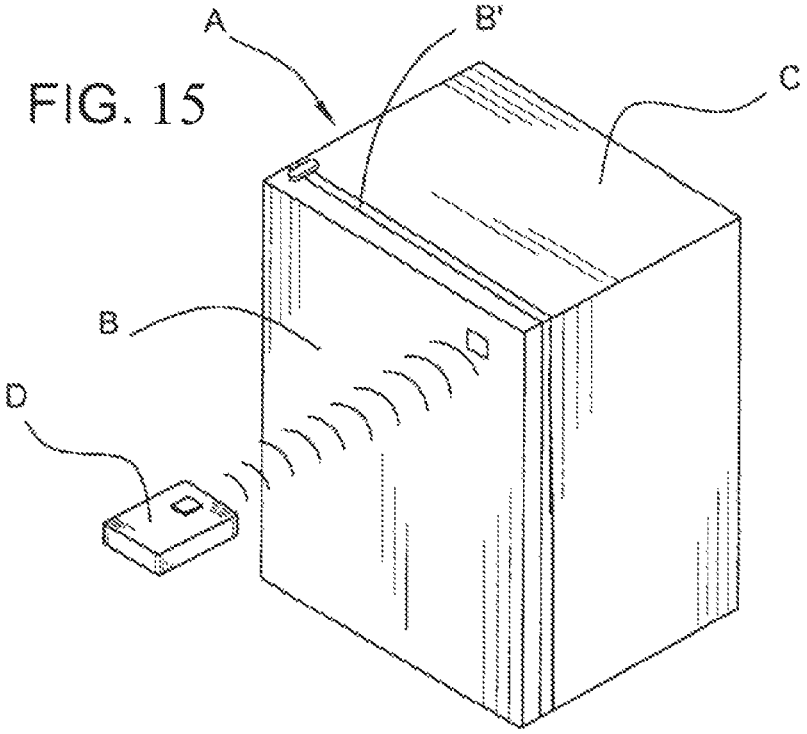
Figure 16:
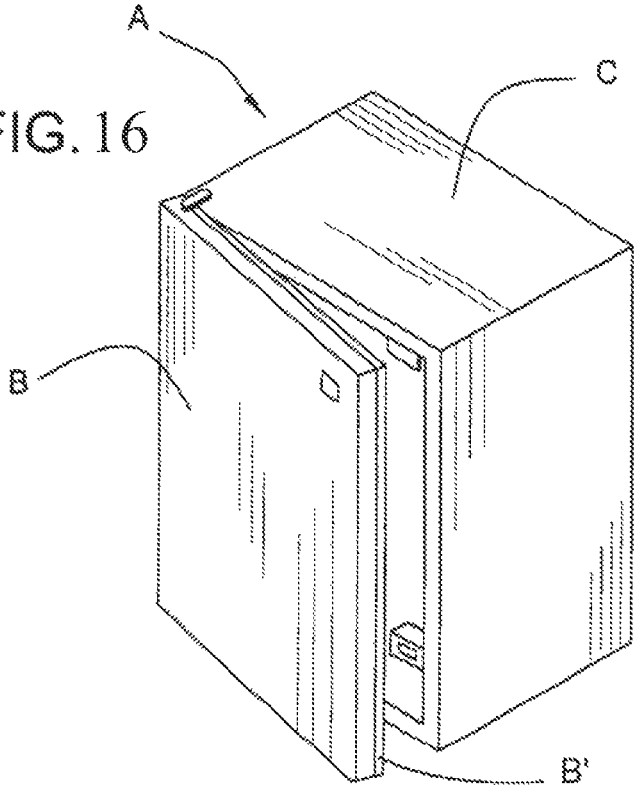
Figure 17:
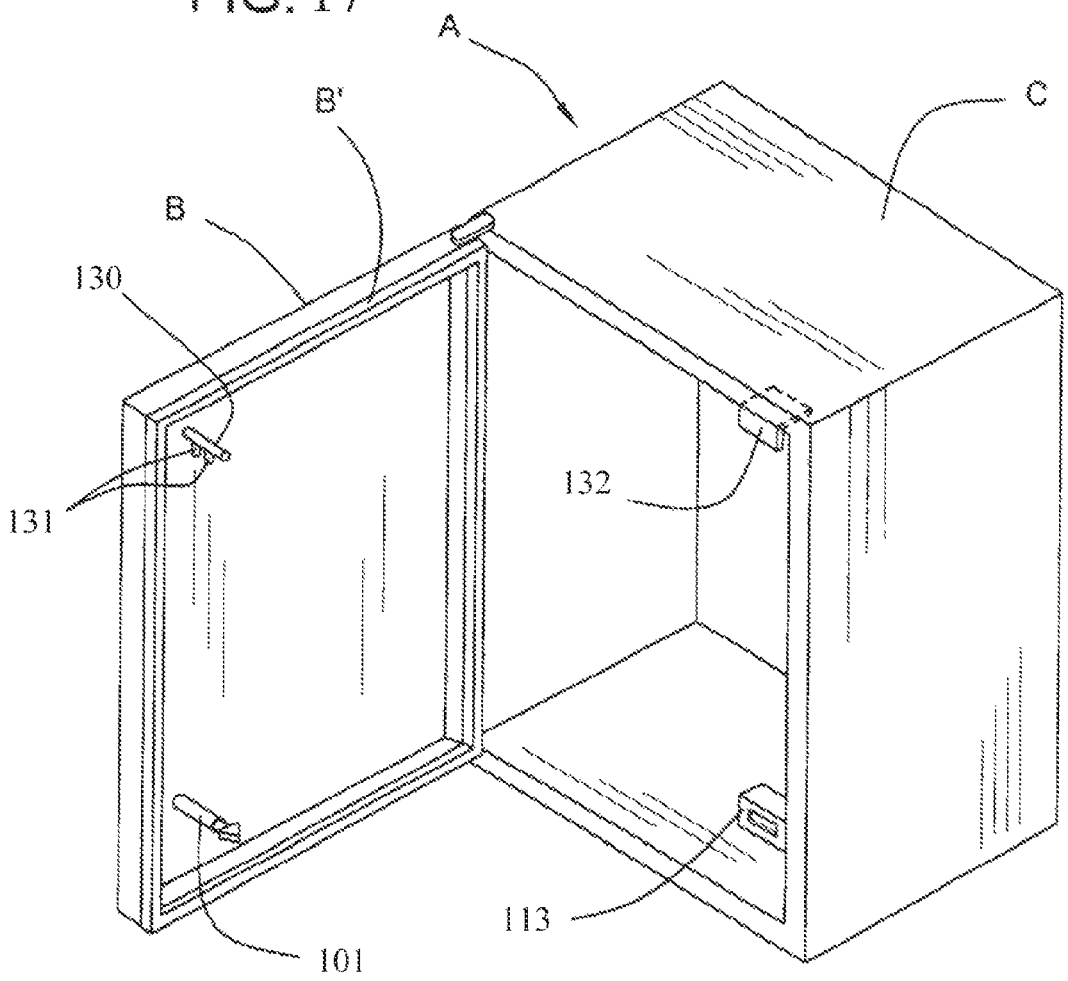
Figure 18:
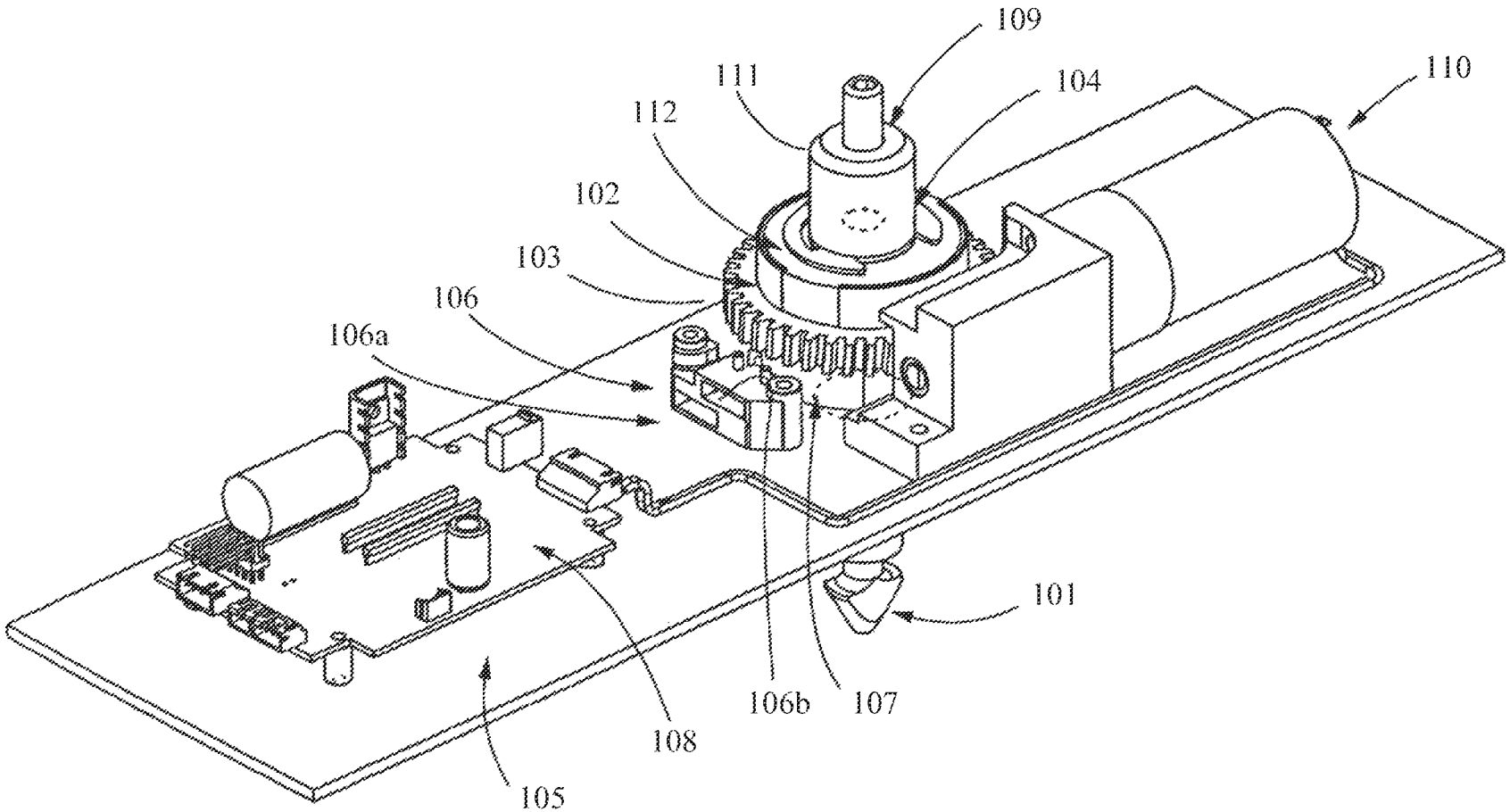

FIGS. 5A and 5B respectively are plan views showing the beginning secure functions for the cam and receiver;

FIGS. 6A and 6B are plan views showing the advancements of the cam into the receiver;

FIGS. 7A and 7B are plan views of the system showing rotational locking and drawing in by the cam;

FIGS. 8A and 8B are plan views showing the cam locking unit in its unlocked position without the receiver;

FIGS. 9A and 9B are plan views like FIGS. 8A and 8B with the receiver;

FIGS. 10A to 10F are perspective views of alternative cam designs useful with the electronic lock;

FIGS. 11 and 12 are flow charts showing respective lock and unlock sequences of operation for the cam locking system;

FIG. 13 is a perspective, partially exploded view of a modified form of a receiver and cam operator; and FIG. 14 is a plan view partially in section of the operating lock of FIG. 13 in a locked portion FIG. 15 is a perspective view of an illustrative vending type machine A with a door B, gasket B' and cabinet C in a closed position and showing a remote controller D;

FIG. 16 is a perspective view of the machine of FIG. 15 with the door opened partially;

FIG. 17 is a perspective view of the machine of FIGS. 15 and 16 with the door opened and showing the locking devices;

FIG. 18 is a perspective view of the bayonet system complete less the receiver unit. Wiring has been deleted to clarify the view. Item 101 is the localized design called a bayonet, it is shown in the secure and pulled in (sealed) position. Item 102 is the cylindrical device with the gear. Item 103 located about its outside diameter. Item 104 is the cover for the cylindrical device. Item 105 is a plate which serves to mount all of the items. The plate generally is part of the device that is to be secured. Item 106 is the electrical detection mount bracket that houses Items 106*a* (SW1) and Item 106*b* (SW2) Item 107 is the local geometry which detects the position of the cylindrical device. Item 108 is the electrical controller board. Item 109 is the adjuster device that positions the bayonet. Item 110 is the motor that provides the drives the gear assembly. Item 111 is the tube. Item 112 is a snap ring that holds the cylindrical device on the tube assembly.

Figure 19:
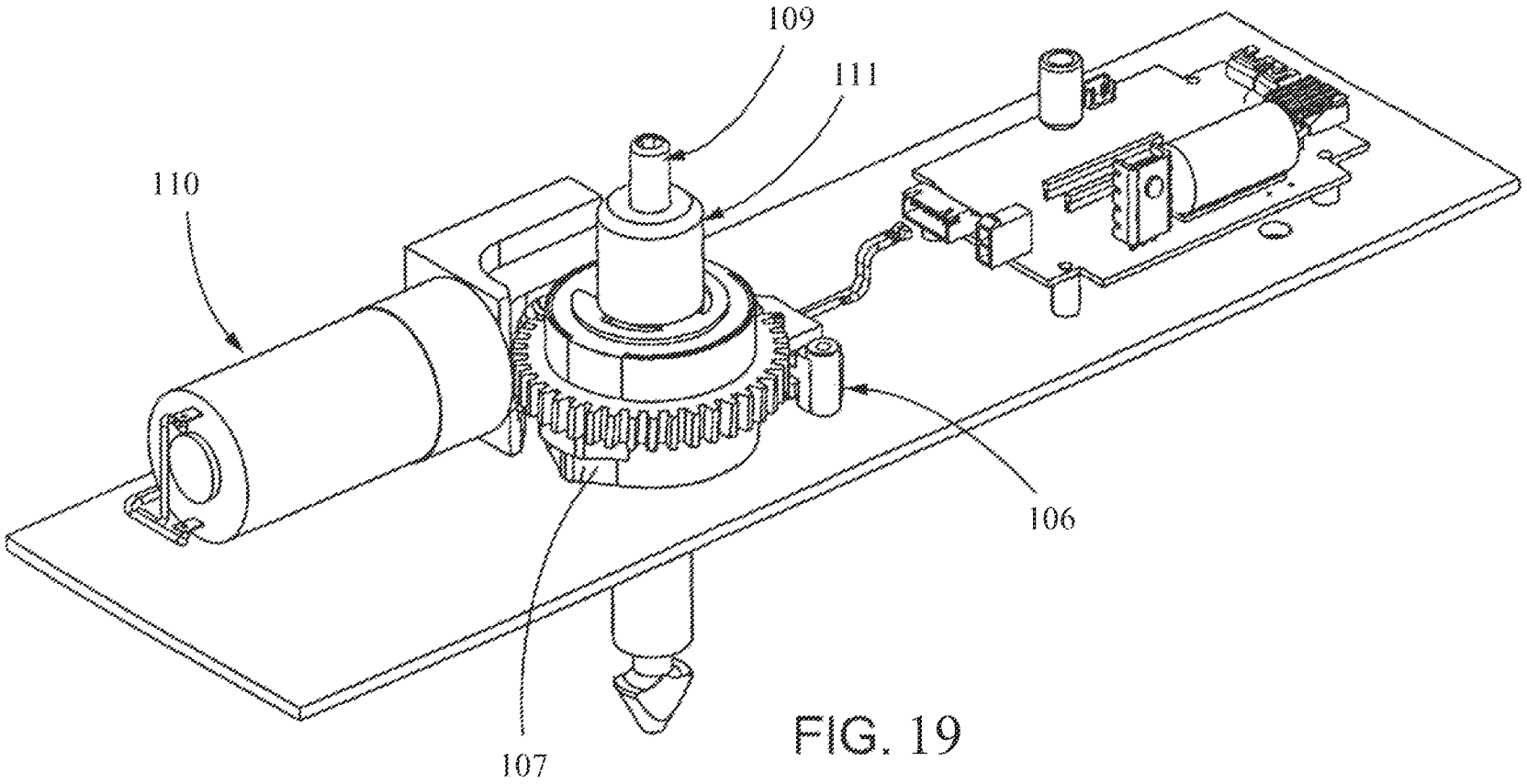

FIG. 19 is a perspective clarifying the position indicators Item 107 of the cylindrical device.

Figure 20:
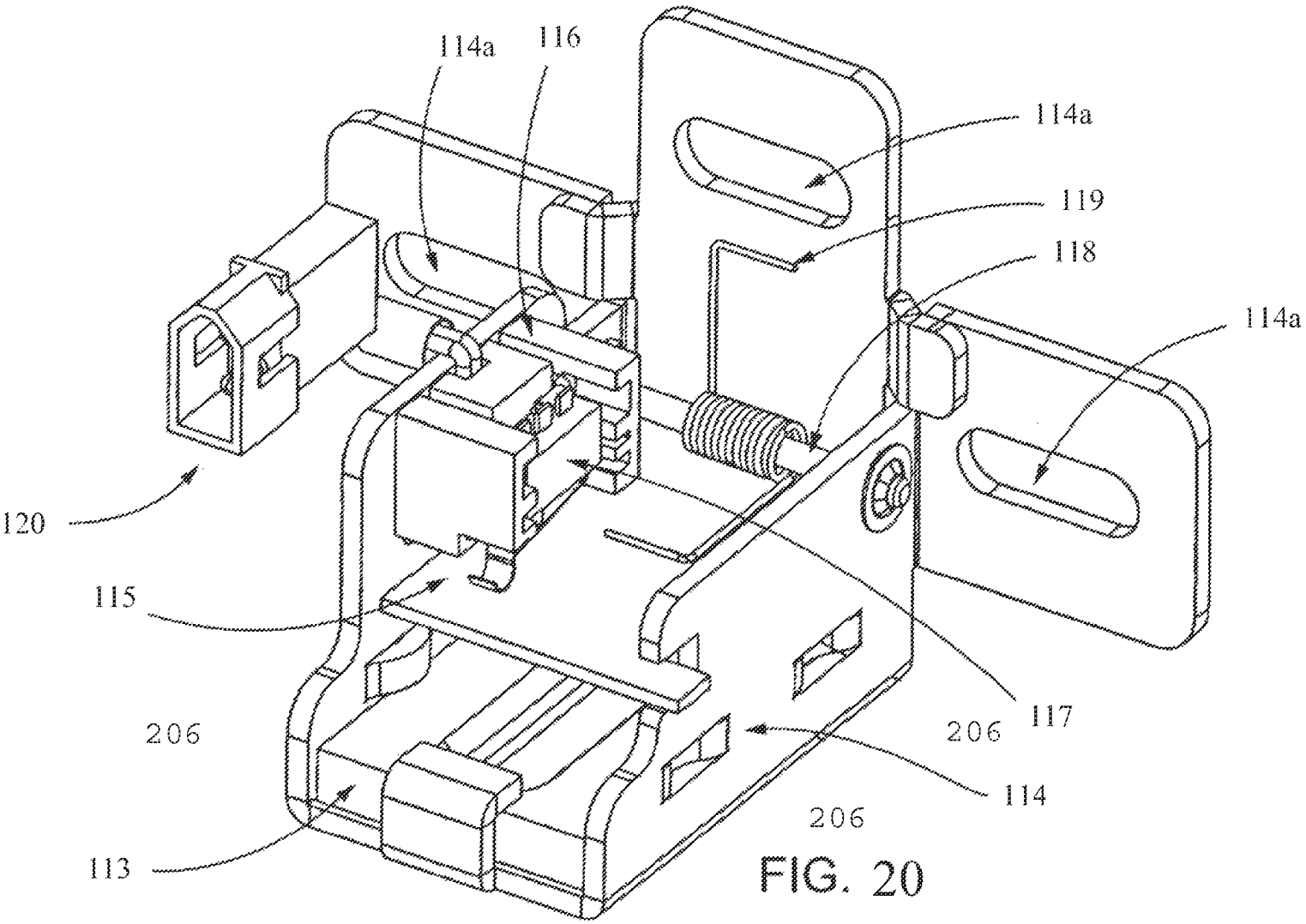

FIG. 20 is a perspective view of the receiver unit. Item 113 is the receiver plate. Item 114 is the housing of the receiver. Item 115 is a door or moveable plate that the bayonet Item 101 pushes as it is inserted into the receiver. Item 117 which is mounted in Item 116 and fasten to Item 114 then switches state. The controller through wiring Item 120 detects this. Items 118 and 119 serve to mount and bias the door assembly. Area Item 114*a* is provided as a typical mounting scenario.

The stationary receiver unit of FIG. 20 is mounted into the stationary cabinet C as shown in FIG. 17 using the holes 114*a*. The slotted plate 113 receives the end arrow section of the bayonet 101 shown in FIGS. 18 and 19. The moveable plate 115 of FIG. 20 is pushed rearward by the arrow section of the bayonet 101, which causes the movable plate to rotate about the axle 118 and activates the switch 117, resulting in activation of the gear motor 110 shown in FIGS. 18 and 19. A flat spring 206 that is nested in both sides of the receiver unit and having two curved shapes allows the slotted plate 113 to move horizontally in both directions. After the arrow section of the bayonet 101 is removed from the stationary receiver unit, the flat spring will reposition the slotted plate 113 about its original centerline position as it relates to the stationary receiver. This movement allows for horizontal manufacturing tolerance for both the cabinet C and the door B as the lock of FIG. 19 and the stationary receiver of FIG. 20 are mounted. The vertical slot in the slotted plate 113 allows for vertical tolerances.

Figure 21:
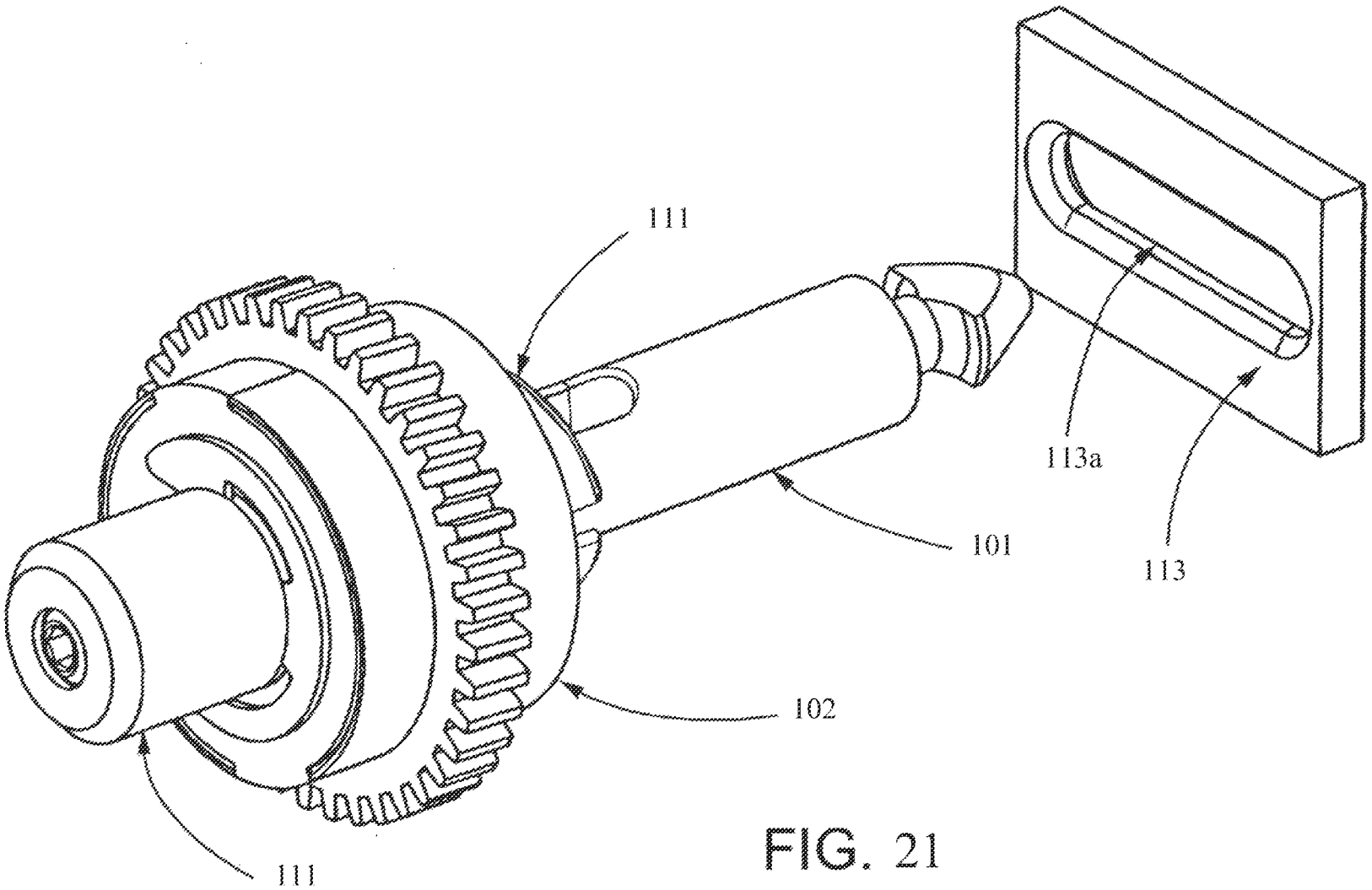
Figure 22:
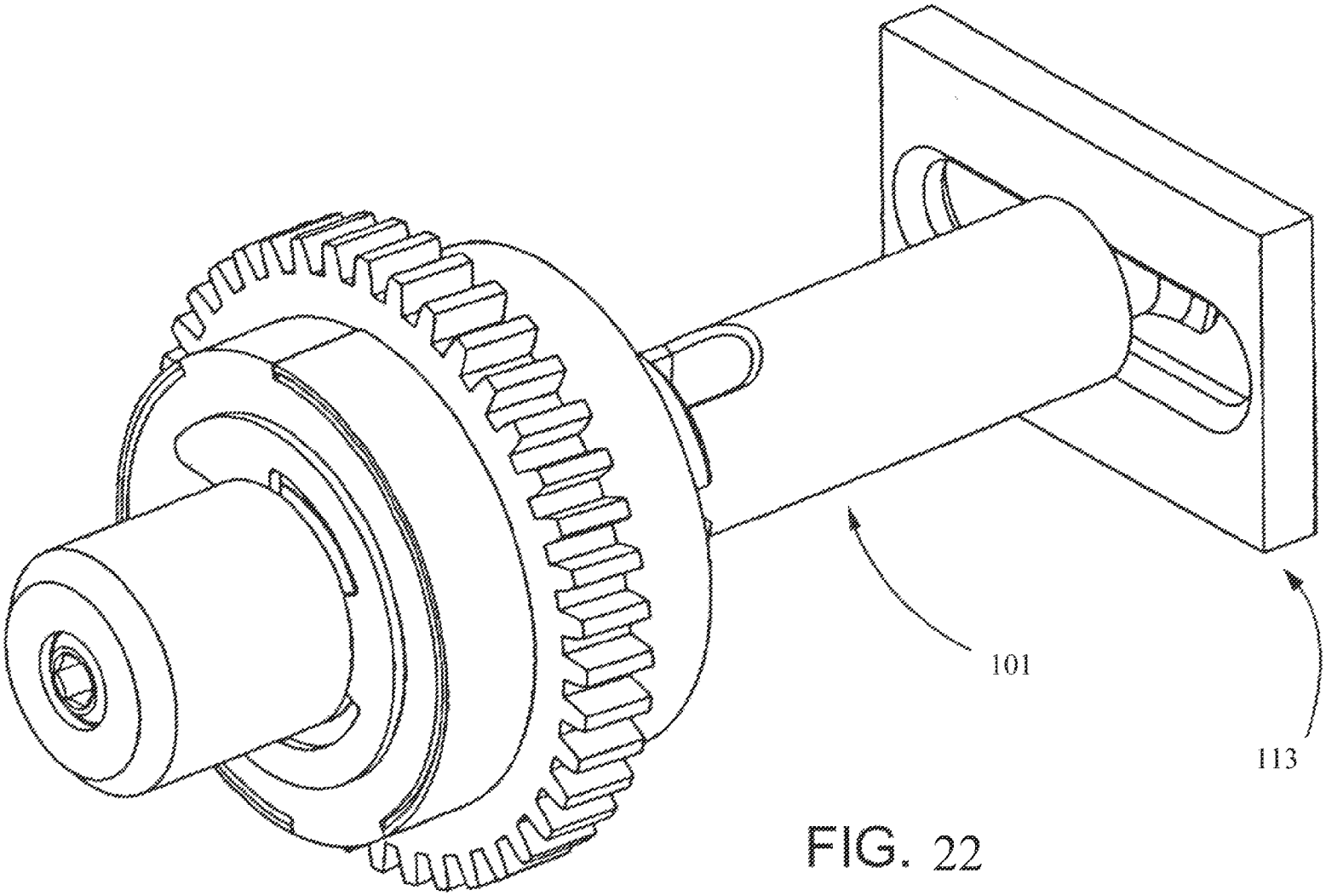

FIGS. 21 and 22 respectively are perspective views of the beginning secure functions. Item 101 is aligned to a slot located in Item 113. Items 111 and 102 move into position (as they are mounted to Item 105) this places the end of the Item 101 behind the Item 113. (FIG. 19). At this time (SW2) changes state serving as a local detection device. FIG. 15 Item 106*b*.

Figure 23:
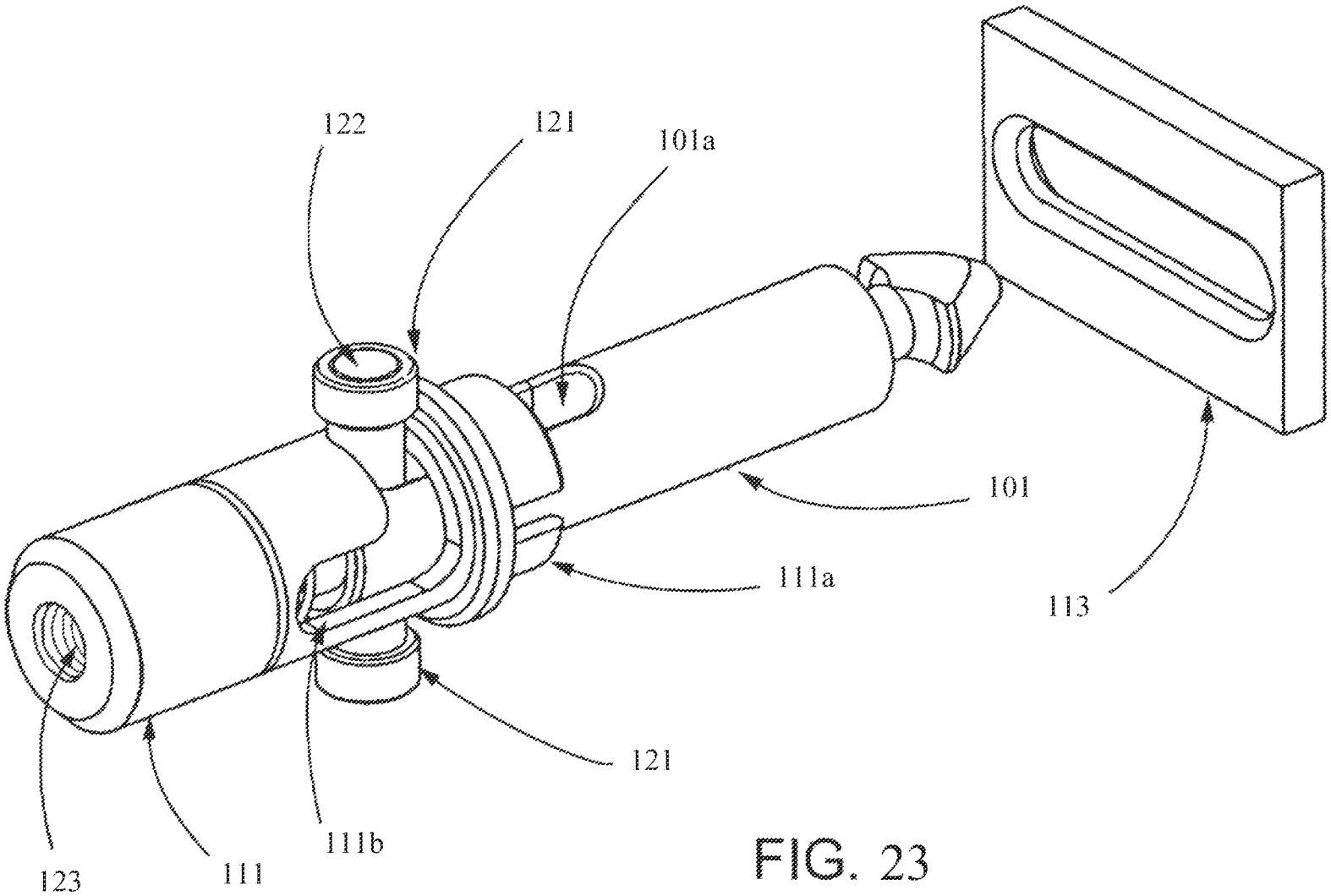

FIG. 23 is a perspective view that has Items 102, 112, and 104 removed. Item 111 is kept stationary via slots located in area 111*a* and with conventional threads. Item 101 has a slot through it to allow a spring action provided by Item 123 as the Item 101 impacts Item 113. The 101*a* slot provides the area for this. The pin Item 122 is held in place by the geometry 111*b*. The rollers Items 121 will provide antifriction surfaces during future operations.

Figure 24:
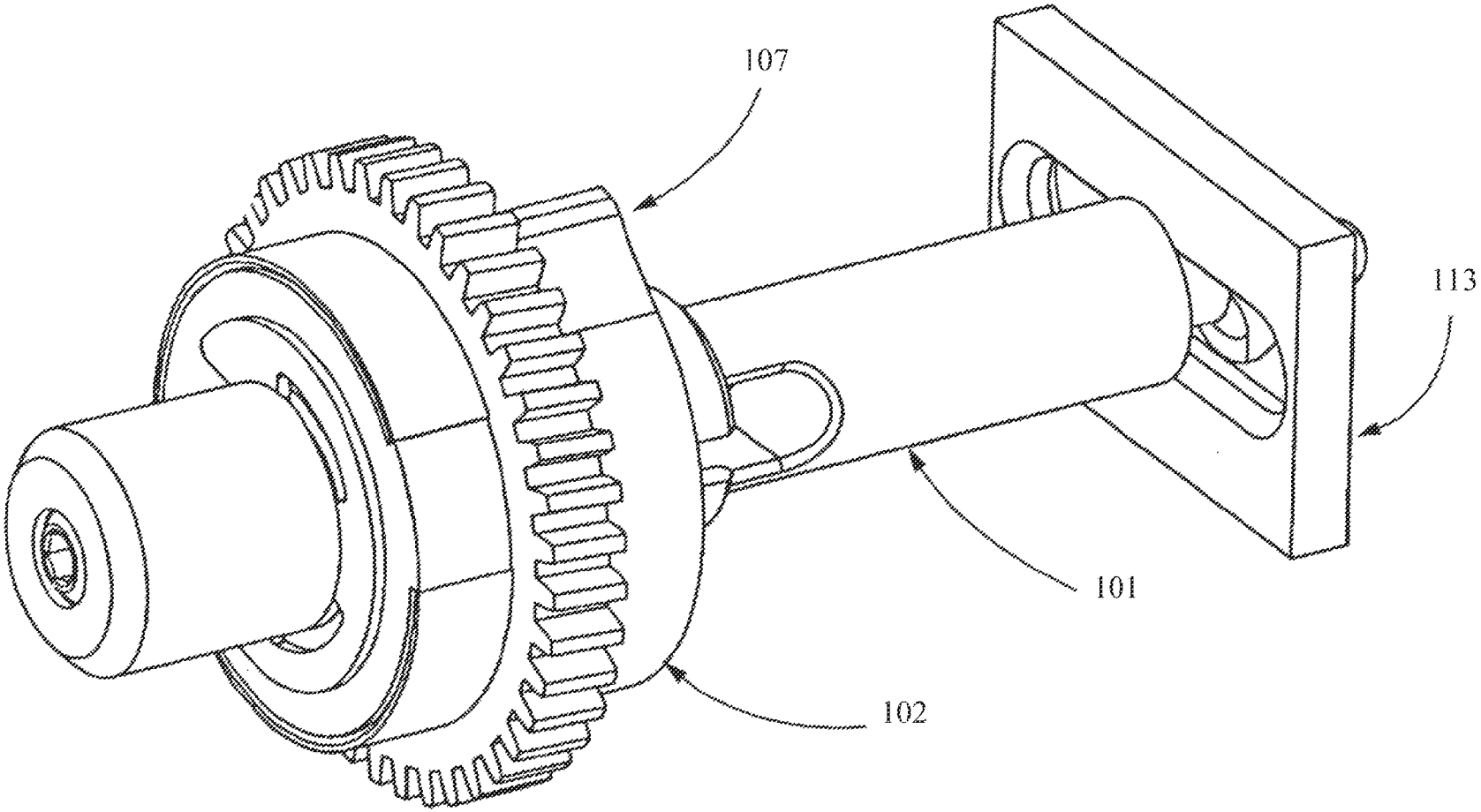

FIG. 24 is a perspective view of the bayonet system in its secure position. The Item 102 has rotated and item 106 FIG. 18 (sw1) has detected the proper position via the Item 107 geometry. Item 101 is now located behind Item 113 and is rotated 90 degrees.

Figure 25:
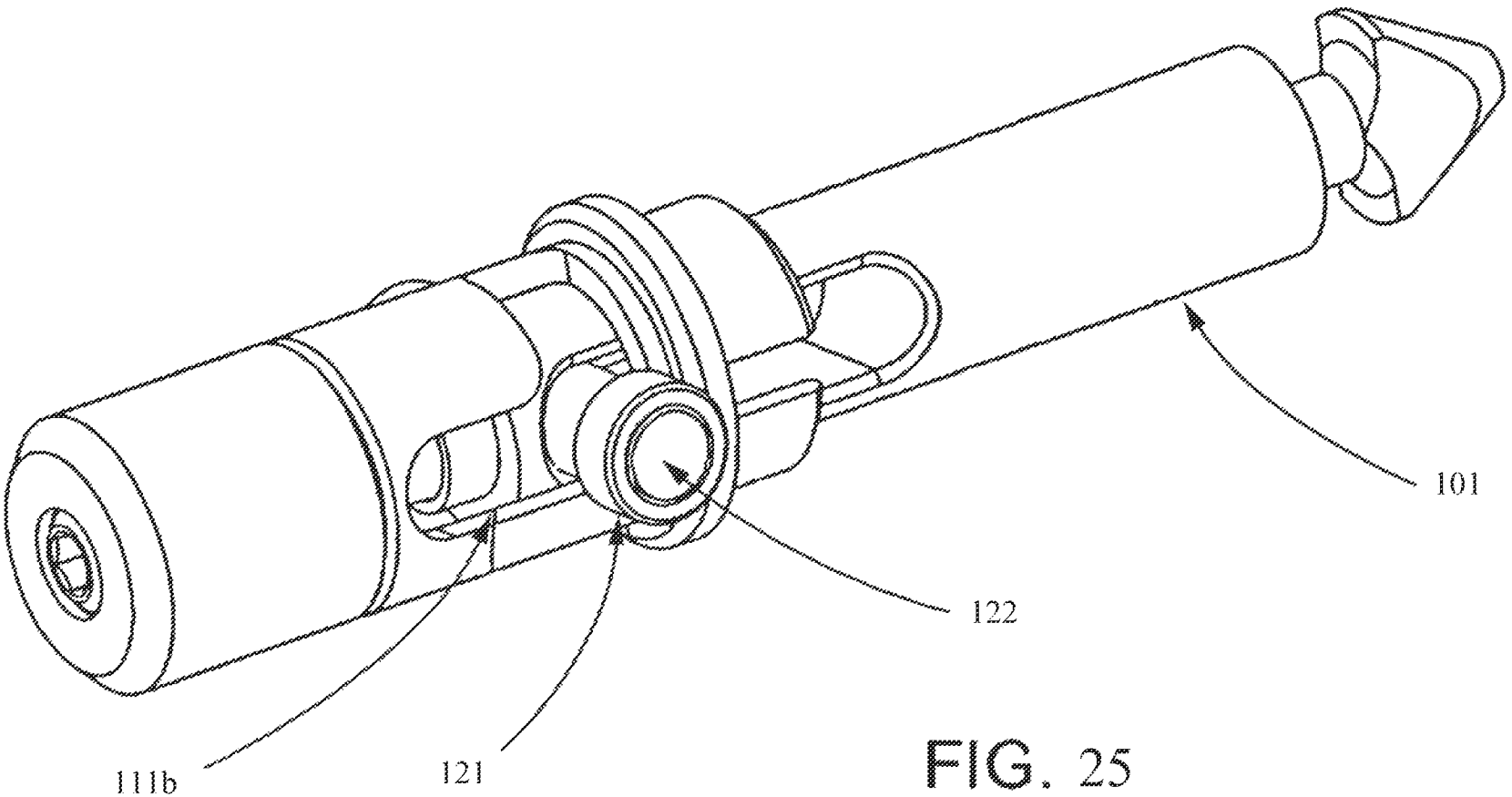

FIG. 25 is a perspective view indicating what the internal geometry is in place at the same time as FIG. 21. Pin Item 122 has moved into position along the 111*b* area. This is accomplished via FIG. 23 area 102*a*. Gear Item 103 rotates about the area 102*e* guided by Item 111. Surface 102*a* causes pin Item 122 to move 90 degrees.

Figure 26:
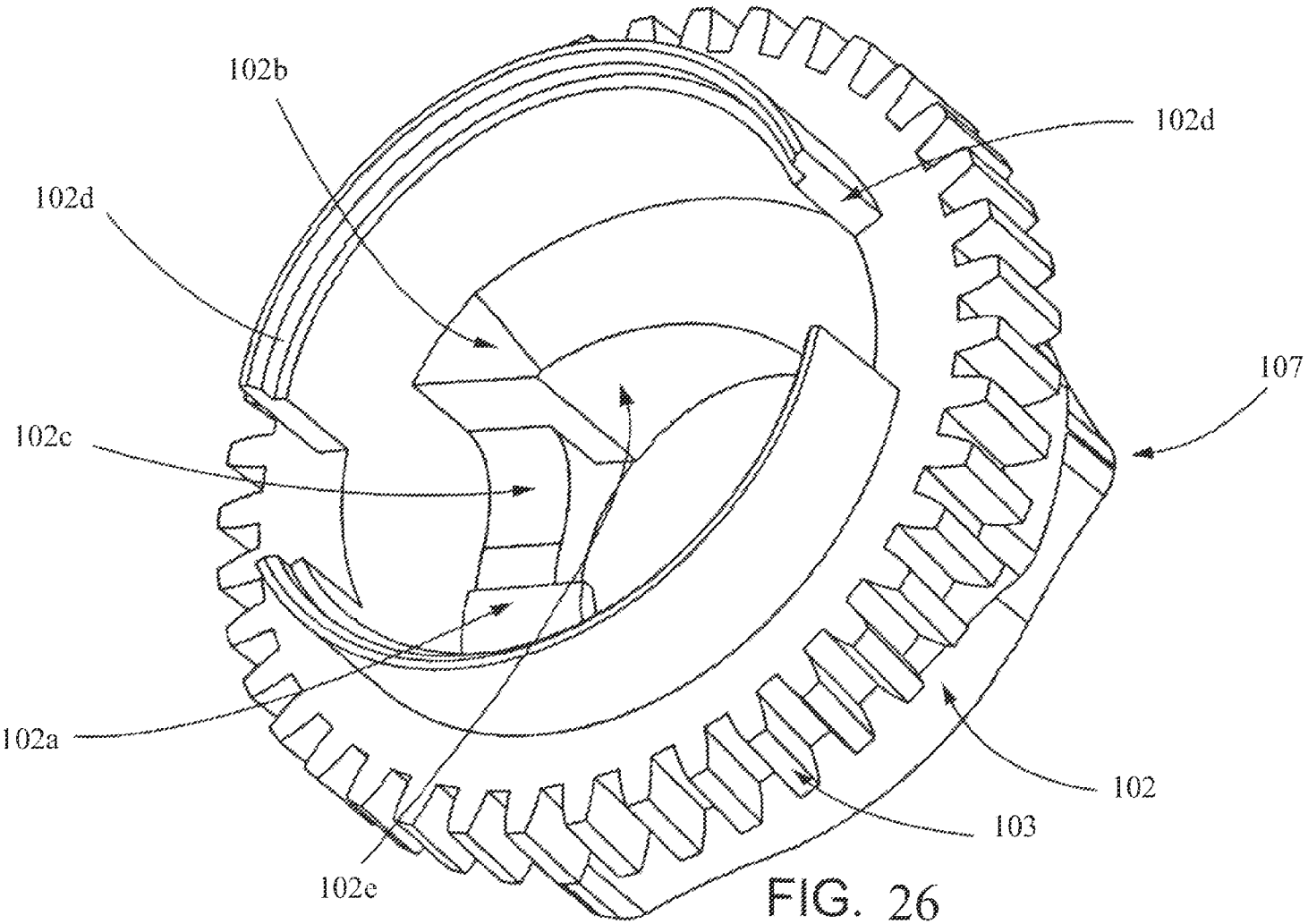

FIG. 26, item 102*d* is provided as mounting surfaces for FIG. 25 Item 104. Surface 104*a* as mounted into Item 102 provide guiding for Items 121 and then translated through to Item 122. Areas Item 104*d* correspond to Item 102*d* FIG. 23. Area 102*a* has a steel reinforced arrangement to prevent deformation of the plastic as it ages.

Figure 27:
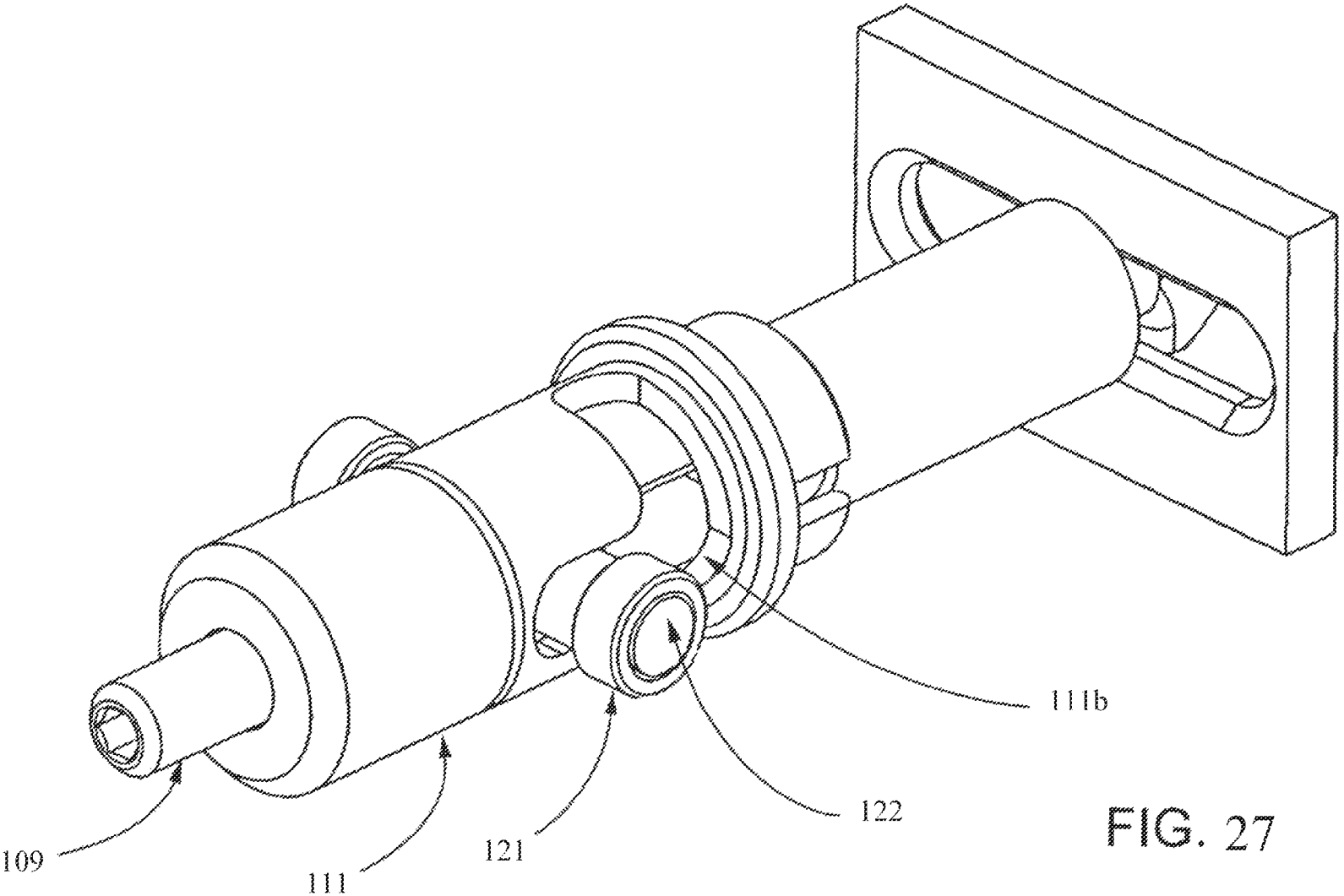

FIG. 27 is a perspective view showing the pulling or sealing function. Item 102 has continued to rotate via the motor Item 110. The local geometry of the ramp area 102*a* through 102*b* causes the rollers Items 121 to move with it. This pulls (moves) the Item 101 back away from Item 113. This is seen by the extension of Item 109 as it protrudes from Item 111.

Figure 28:
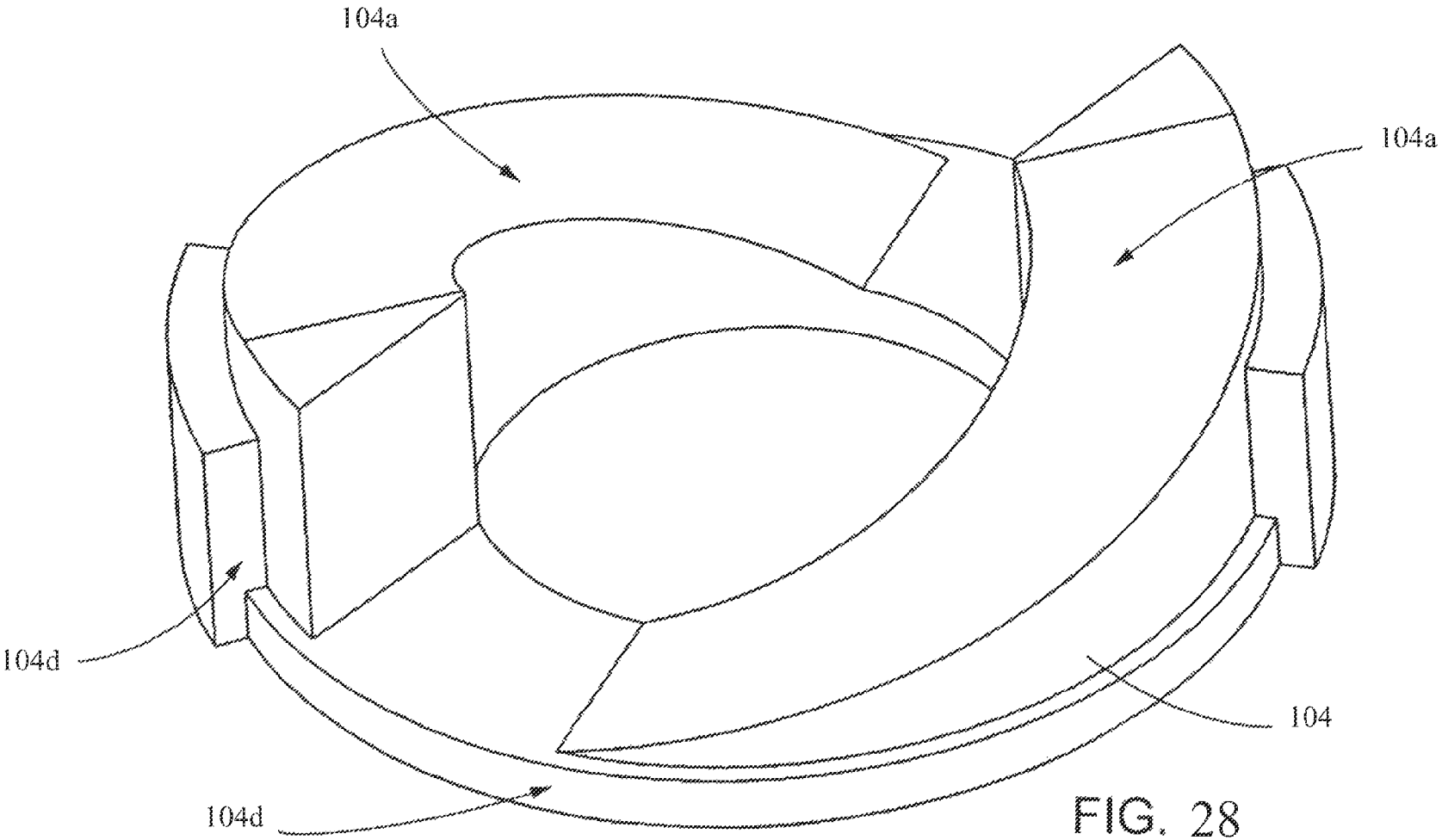

FIG. 28 is a perspective view of the outer guide that mates with the FIG. 23 guide.

Figure 29:
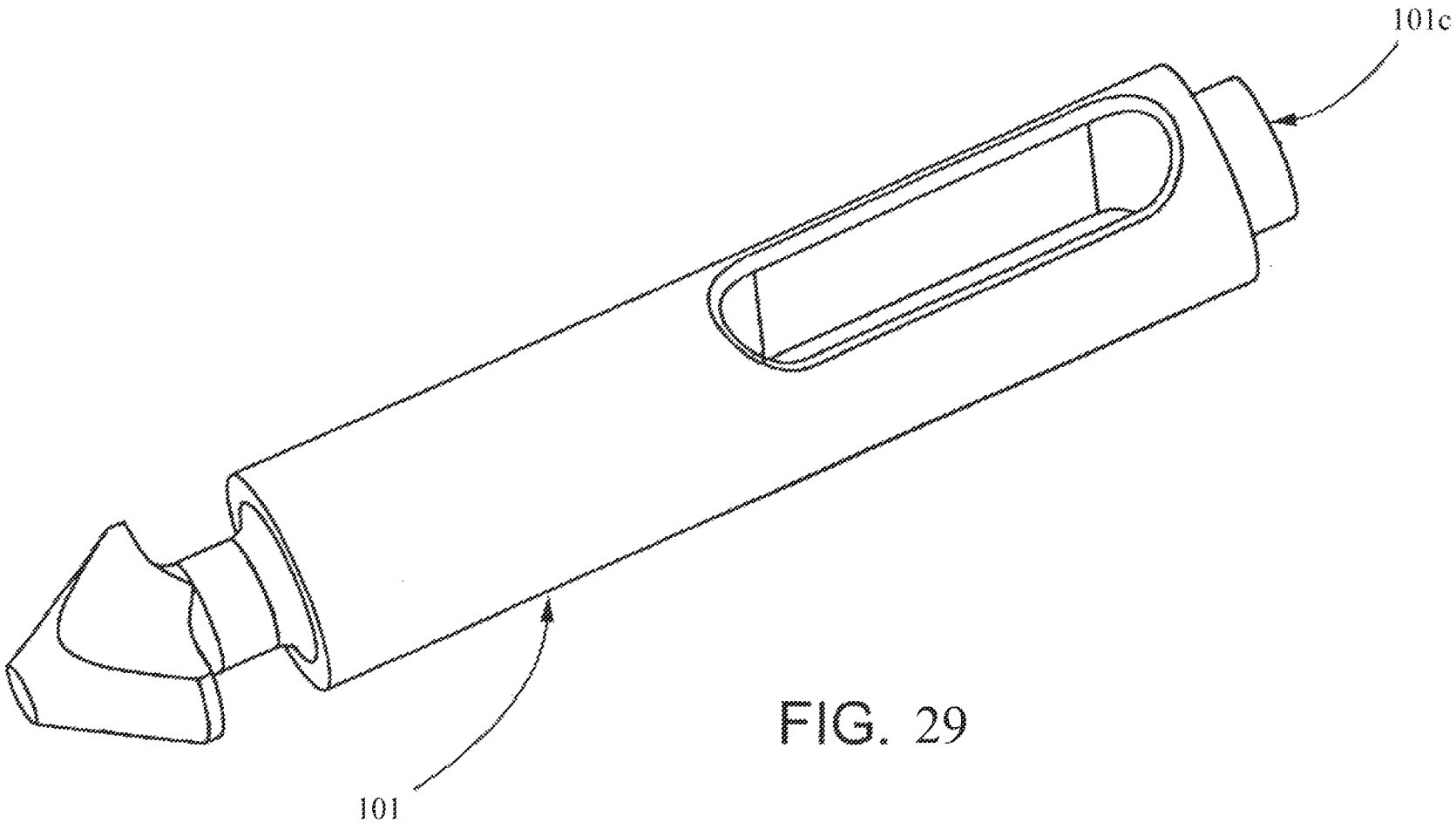

FIG. 29 is a perspective view of the bayonet Item 101. Item 101*c* is threaded to facilitate the adjuster screw Item 109. This screw limits the travel of the Item 101 by intersection of the pin Item 122 with the bottom of the Item 119.

Figure 30:
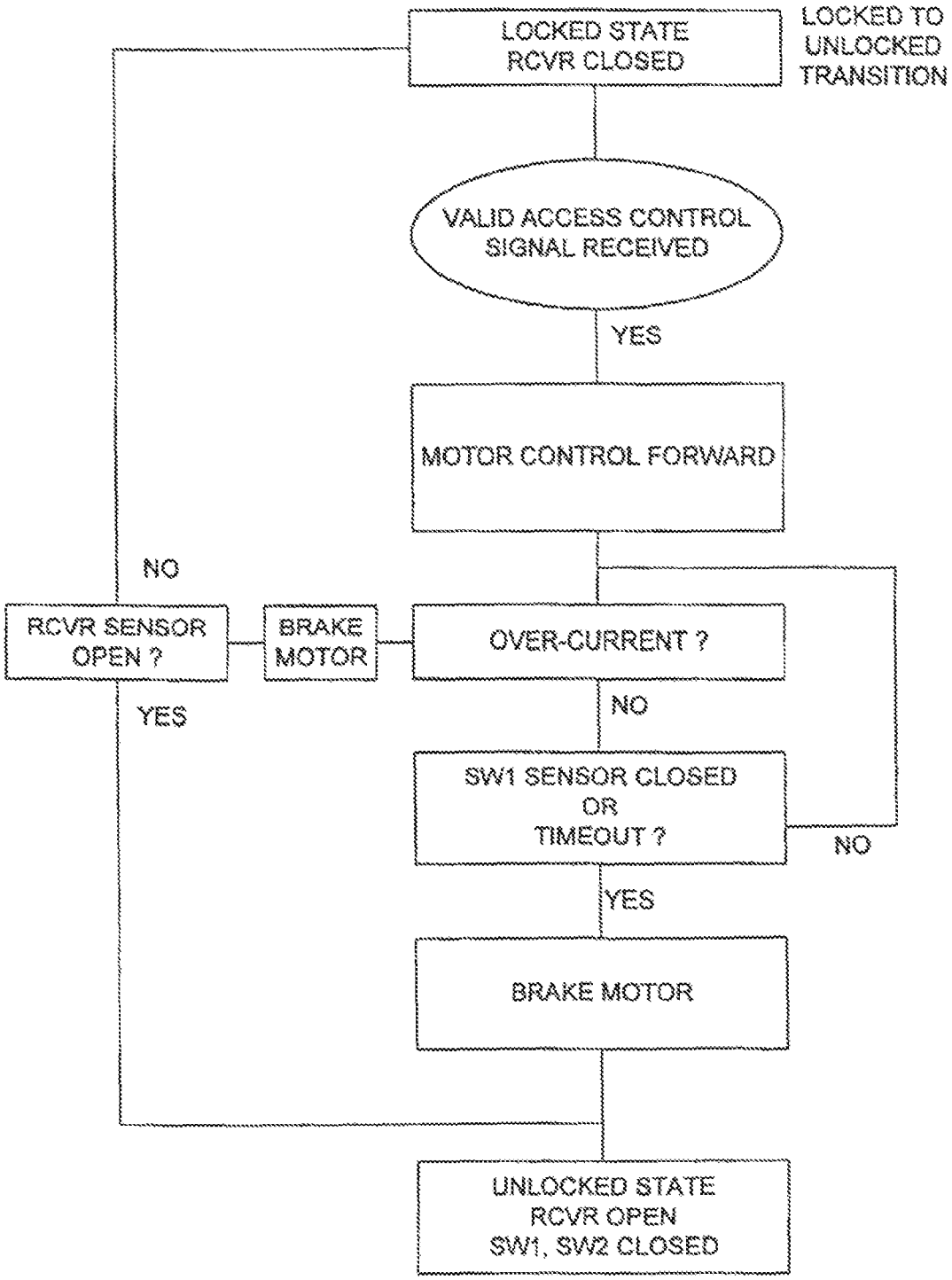
Figure 31:
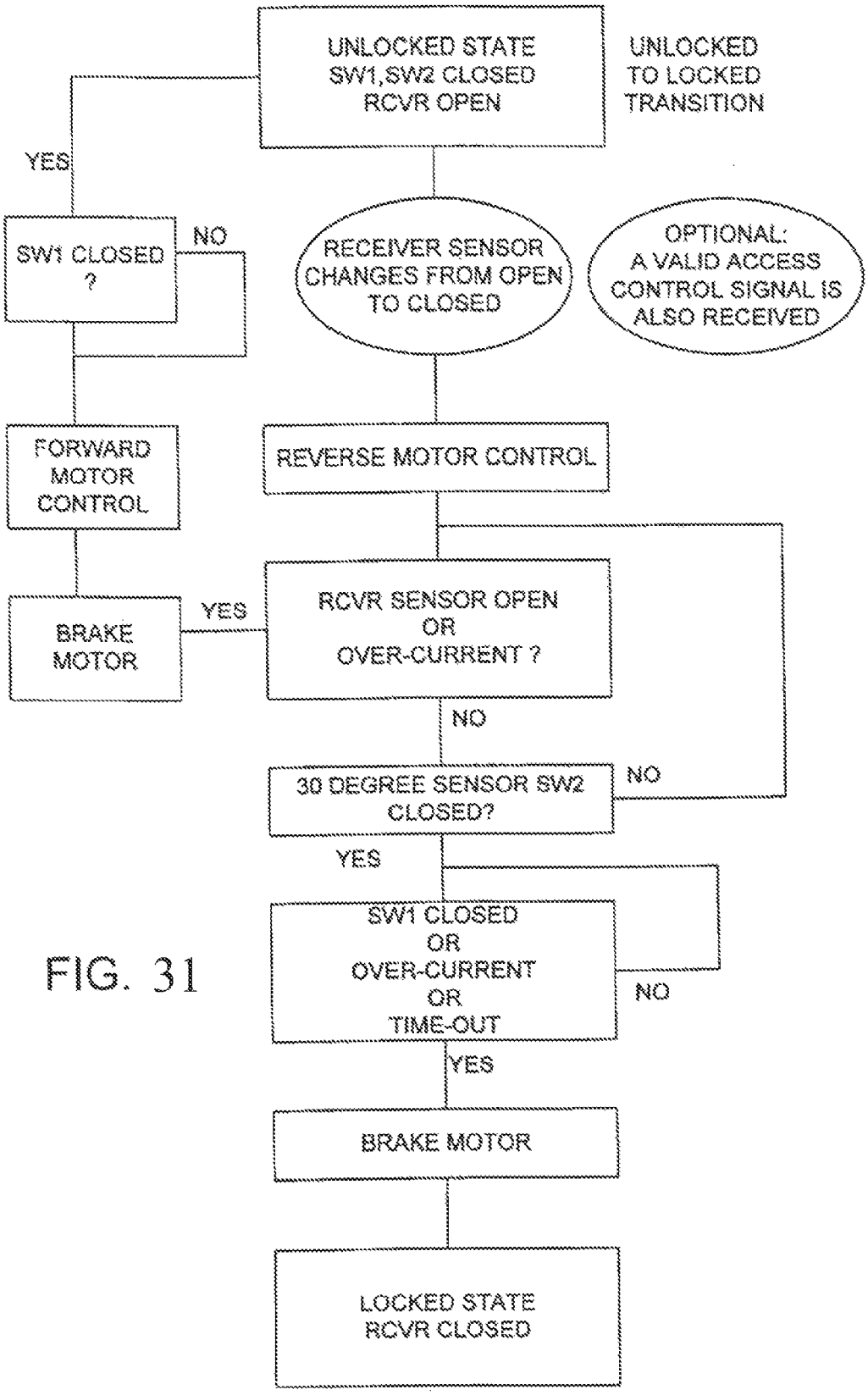

FIGS. 30 and 31 are flow charts showing the respective lock and unlock sequences of operation for the bayonet locking system.

Between Item 102 and mounting plate Item 105 mounting plate there is a thin plate to allow for a sliding friction plate surface this allows for a lubrication area.

In consideration of the electrical functions of the system the following description applies to the controller utilized. This controller features unique combination of sensing and control that differentiate it from controllers used in the public domain.

DETAILED DESCRIPTION OF THE INVENTION

Locked to Unlocked for Both the Cam and Bayonet Locking Systems:

For specific details of the electronic control operation, reference may be made to our co-pending application publication Jul. 28, 2005 as US 2005/0161953A1. In controlling the motor to change the state of the lock from locked to unlocked, the controller must first receive a valid access control signal from the operator (via a secure access control input means such as a keypad or hand-held transmitter) and shall proceed to energize the motor in the forward direction. The controller will wait for a position feedback indicator which is measured by a controller CPU to determine the lock has landed in the unlocked state. If this sensor is closed, the controller will proceed to break and de-energize the motor. In case the sensor is failed, the controller uses a motor current feedback signal to detect end of worm gear travel by sensing a stall motor condition and to de-energize the motor. In case both sensors fail, the controller will discontinue operation based on elapsed time.

In the case an over-current signal is received, the controller must determine if this signal is a function of a jammed cam with the lock still in the locked state, or if this signal is a function of the worm gear reaching the unlocked state and the sensor failed. In the case of a jam, the receiver sensor is expected to be closed and the condition is still locked. Thus, the controller will proceed to assume a locked condition. In the case the receiver sensor is open, it as assumed that the cam has unseated from the receiver and the lock is unlocked. Thus, the controller will proceed to the unlocked state.

Figure 2:
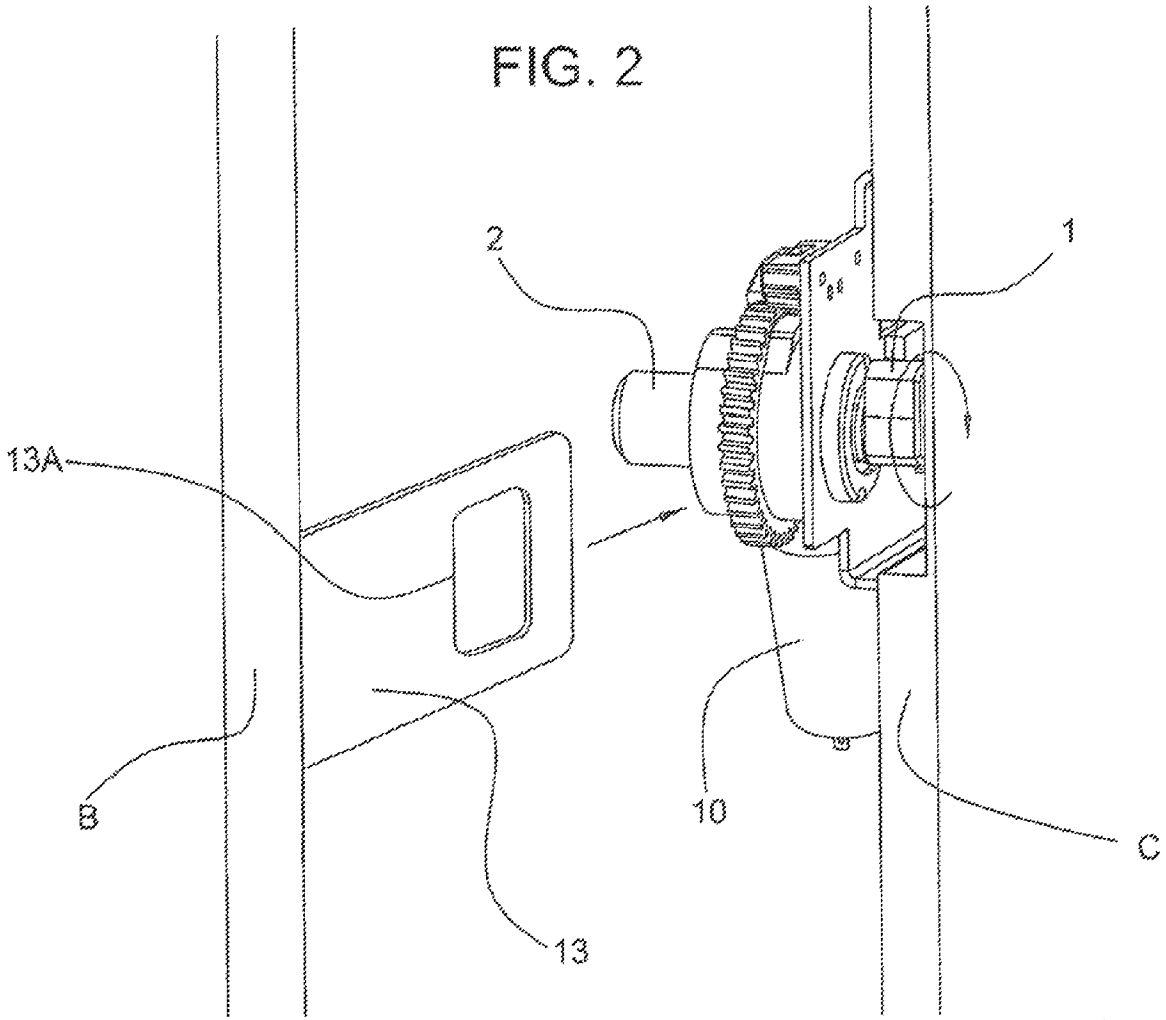
FIG. 2 is an enlarged perspective view of the system with the door mounted receiver and cabinet mounted cam operating lock.

Unlocked to Locked for the Cam Locking System:

In controlling the motor, FIG. 2, item 10 to change the state of the lock from unlocked to locked, the controller shall wait to receive a valid lock signal from the operator. This signal shall at a minimum be a sensor signal received by the controller whether the cam, FIG. 2, item 1 is positioned to be seated in the receiver.

Figure 3:
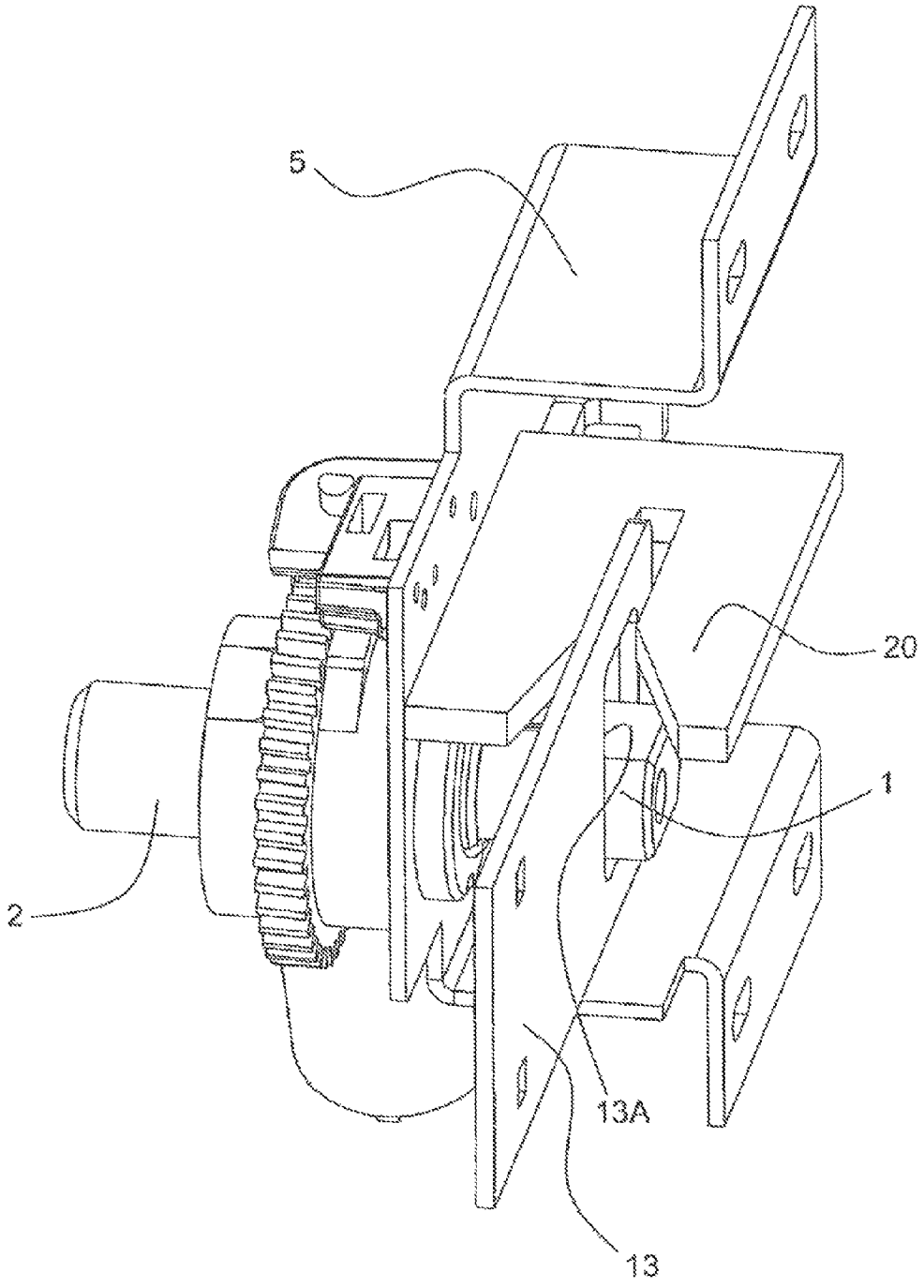
FIG. 3 is an enlarged perspective view of the receiver and cam operator in a locked position free of the door and cabinet.
Figure 4:
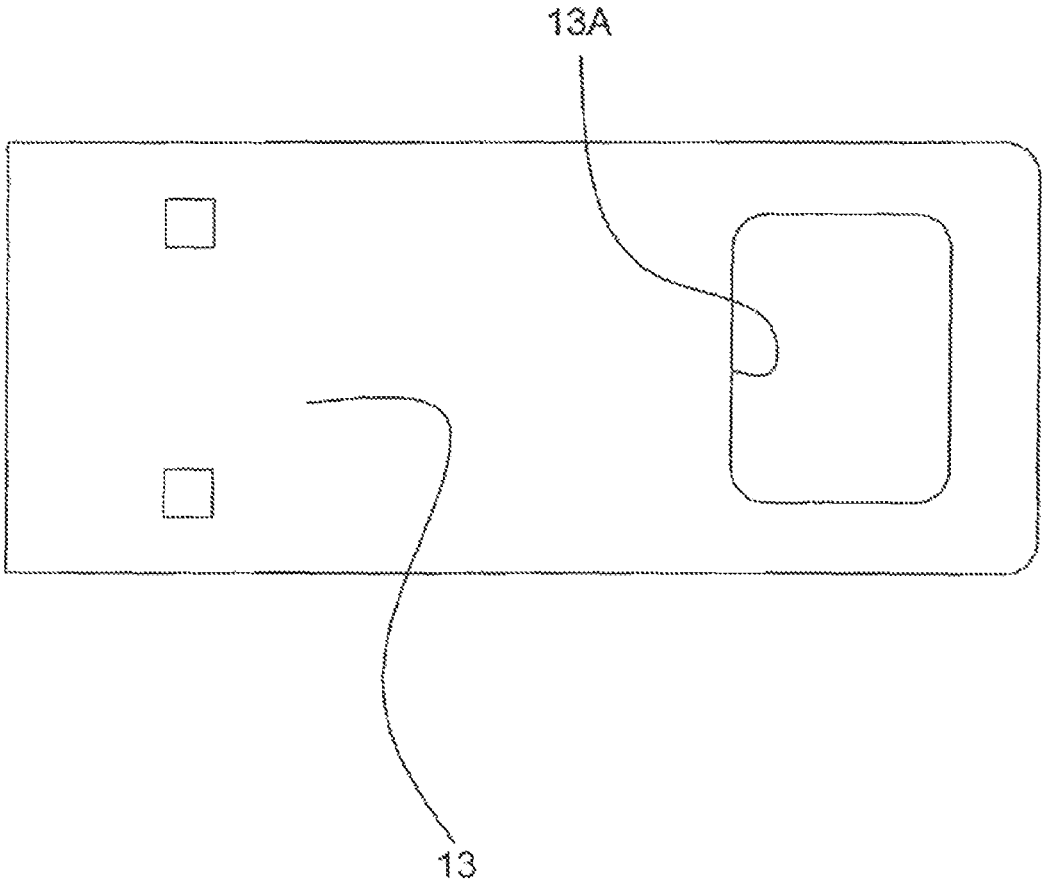
FIG. 4 is a plan view of the receiver.

The receiver 13 sensor FIG. 4 is a plate like a member with a slot opening 13A preferably mounted to door B (FIG. 1), which is open when the lock is unlocked In FIGS. 2 and 3 there is shown the sequence of closing and locking a vending machine door in accordance with the present electronic cam lock system, Door B carrying the receiver 13 with slot opening 13A is moved toward the cabinet C which here carries the cylinder driven unit 2 which operates the cam element 1. In FIG. 3, the plate receiver is guided in place by a Y slot guide 20, the motor drive advances the cam 1 into the slot 13A and the unit 2 is ready for rotation of the cam 1.

As seen in FIGS. 5A and 5B, the receiver 13 will engage a spring held side 17 that can be moved horizontally to sense the positioning of the receiver with respect to the retracted or unlock position of the cam 1. The slide 17 has a sloped notch area 18 which operates sensor switch 19 to provide the signals for when the locking and unlocking actions can be operated by a controller and the motor drive unit. When the cam 1 is in position and the sensor switch allows the motor drive to operate, FIGS. 5A and 5B, the cam 1 is advanced longitudinally as shown in FIGS. 6A and 6B so that receiver 13 is captured and the door is held closed. Referring to FIGS. 7A and 7B the cam 1 is rotated within slot 13A and the result is that a door carrying receiver 13 would be pulled in. The drive motor 10 rotates the cam 1 in the receiver and pulls in the door until the sensor signals the cam position for the controller to stop the motor. During locking if switch 19 senses that the receiver has moved back out of position before the cam 1 enters the slot the motor is reversed and the unlock position is maintained until the next cycle.

Figure 1:
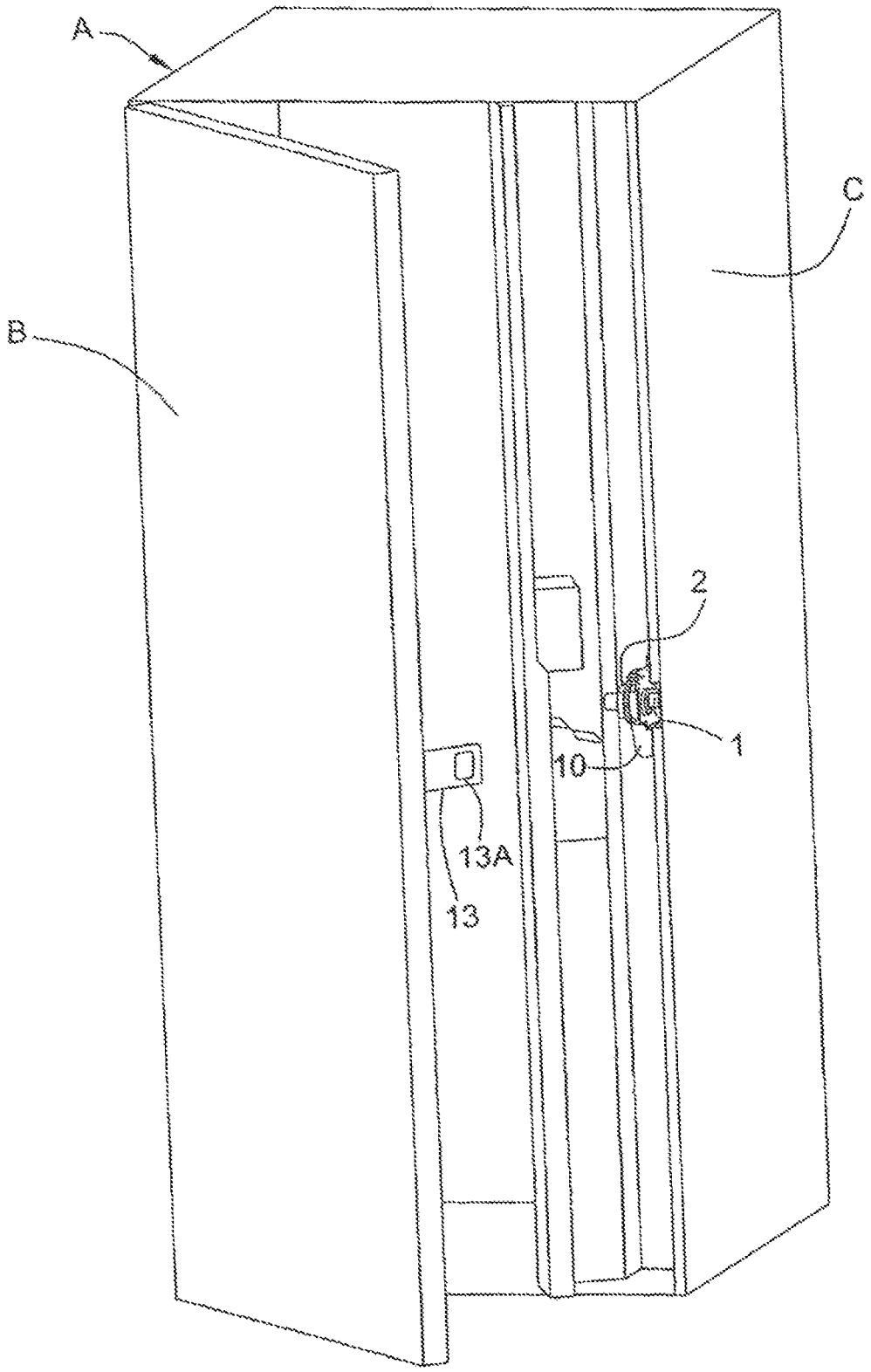
FIG. 1 is a perspective view of an illustrative vending type machine A with a door B and cabinet C in a partially open position showing the locking devices.

In FIGS. 8A and 8B, the cam 1 driving unit 2 and its components are shown as mounted to a bracket 5 which is easily attachable to a cabinet as in FIGS. 1 and 2. The cam element 1 is shown in the retracted and unlock positions.

Figure 10A:
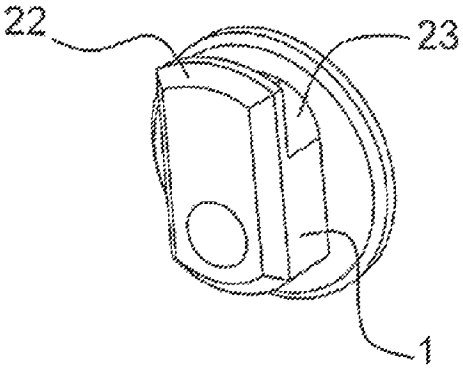
Figure 10B:
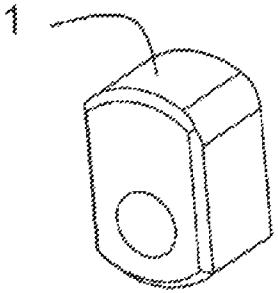

Referring to FIGS. 10A-F, there is shown various alternative cam 1 elements which can be used with the present locking system. FIG. 10B shows the same cam as in the previous FIGS. 1-9, and it is preferably used with a guide 20 as shown in FIG. 3.

FIG. 10A shows a notched element 1 with a raised lip 22 and notched 23 which would coact with receiver 13, slot 13A for a self guidance action. It is similar to the bayonet catch action of applicants' referenced patents.

Figure 10C:
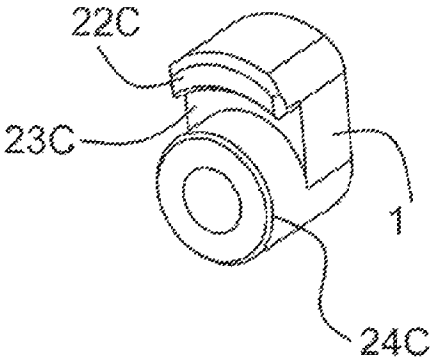

FIG. 10C shows another notched form with a notch 23C and a horizontal lip 22C. This form provides a tip 24C to guide the cam into slot 13A.

Figure 10D:
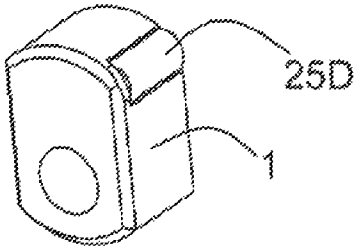
Figure 10E:
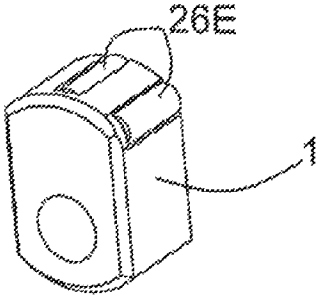
Figure 10F:
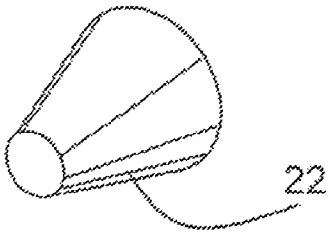

FIG. 10D shows a cam form with a single roller 25D and FIG. 10E shows a double roller 26B for smoother transitions and increased cam life in more demanding and heavy duty applications, respectively. FIG. 10F shows a shaped cam 28 that is generally conical. It will enter the receiver slot and provide pull in with the longitudinal movement of the driving unit and rotation is unnecessary to its operation. Rollers, not shown, can be carried by the receiver or the conical shaped cam to reduce wear and friction.

Flow charts FIG. 11 and FIG. 12, respectively indicate the lock to locked events and vise versa for the cam locking system. The sensor switch 19 which is operated by slide 17 that determines the position and absence of the receiver 13 provides the requisite signals for the controller to operate the motor 10.

Referring to FIGS. 13 and 14 there is shown a locking system like the one discussed with respect to FIG. 3, for example, but with additional support means for the outboard end of the cam when in the extended portion. This provides additional strength against attempted prying open of the door.

In accordance with the present aspect of the invention, the cam 1 is preferably like that in FIG. 10C. A plate member 30 that can be affixed along wall bracket 5, carries a bushing means 32 into which the extended portion 24*c* of cam 1 fits and provides strengthened support of the cam outboard end.

As explained further herein, the present invention can be used with an axially rotatable pin with a finned end here shown on the door B in FIG. 17. The pin upon rotation when the door is closed catches one of the fins against a bracket 132 on the cabinet C. Placement of at least one of such pin and bracket arrangements prevents prying of the door at a corner. With the cam locking means adjacent an opposite corner, both door opening corners are protected.

Unlocked to Locked for the Bayonet Locking System:

In controlling the motor FIG. 18 item 110 to change the state of the lock from unlocked to locked, the controller FIG. 18 Item 108 shall wait to receive a valid lock signal from the operator. This signal shall at a minimum be a sensor signal received by the controller that the bayonet FIG. 17 Item 101 is seated in the receiver as indicated by FIG. 19 (Receiver sensor closed). It is a requirement that the controller must measure the state change of the receiver sensor FIG. 20 Item 117 from open to closed circuit in order to initiate the locking event. In addition to this signal, the controller FIG. 18 Item 108 may also expect to receive a valid access control signal from the operator simultaneously, for example the electronic key. This dual signal requirement would serve the purpose of insuring the operator will not accidentally lock the access control means in the enclosure. The controller FIG. 18 Item 108 shall proceed to energize the motor FIG. 18 Item 110 in the reverse direction. The controller FIG. 18 Item 108 will wait for a position feedback indicator FIG. 18 Item 106*a* (SW1) which is measured by the controller CPU located on FIG. 18 Item 108 to determine the lock has landed in the secure state. In case the FIG. 18 Item 106*a* (SW1) sensor is failed, the controller uses a motor current feedback signal to detect end of FIG. 26 area 102*b* end of travel by sensing a stall motor condition and to de-energize the motor. In case both sensors fail, the controller will discontinue operation based on elapsed time.

In addition to the typical locking control operation described above, several safety and fault tolerant monitoring processes must be included in the locking control algorithm. For example, when the controller proceeds to energize the motor, the bayonet will begin to turn and will proceed to be captured behind the stationary receiver device to accomplish the locking feature. At this interface, there can exist a misalignment of the bayonet to the receiver FIG. 17 item 113 and the bayonet Item 101 can jam into the receiver surface area FIG. 21 area 113*a*, which would cause a failure of the lock. This failure can be detected by the electronics, which would proceed with a reinitialization process of the lock components (lock bayonet and controller).

The bayonet jam detection will most likely take place during the period the bayonet is rotating to pass behind the receiver. This period is detected by the controller by monitoring a feedback sensor that measures the FIG. 18 Item 102 which relates to the bayonet position, referred to as the FIG. 18 Item 106*b* 30 degree sensor SW2. To properly recover from a bayonet jam event during the bayonet rotation period described above, the detection system we chose to implement is a system where the lock motor controller FIG. 18 Item 108 monitors two sensors and controls the lock motor FIG. 18 Item 110 as described below:

The bayonet receiver sensor FIG. 20 Item 117, which is open when the lock is unlocked, would produce a closed signal when the bayonet seats in the receiver to initiate the locking event. Referred to as closed but not secure. If while the FIG. 18 Item 106*b* (SW2) sensor is closed (less than 30 degrees rotation), the receiver later produces an open signal to the controller to indicate the bayonet is no longer properly aligned behind the receiver.

A sensor that measures the current draw of the motor turning the bayonet. If while the FIG. 18 Item 106*b* (SW2) sensor is closed and motor current exceeds a predetermined value which equals the stall current value of the motor selected for the application, the controller will determine that the bayonet is jammed into the receiver, or, possibly another type of bayonet restriction exists.

The bayonet jam recovery procedure that the controller shall follow is described below:

The controller FIG. 18 Item 108 shall proceed to de-energize the motor FIG. 18 item 110 to stop the bayonet FIG. 18 Item 101 from attempting to turn.

The controller shall proceed with a forward energization of the lock motor to return the bayonet to the fully unlocked position. Once the FIG. 18 Item 106*a* (SW1) sensor is closed and the fully unlocked position FIG. 21 is achieved by the bayonet, the controller will brake the FIG. 18 Item 110 motor and the controller FIG. 18 Item 108 will return to the unlocked operation mode. In this mode, the controller FIG. 18 Item 108 will wait for a locking initiation signal from the operator via a state change from open to closed by the receiver sensor. FIG. 20 Item 117.

Flow-charts FIG. 30 and FIG. 31, respectively, indicate the lock to unlocked events and vise versa for the bayonet locking system.

In accordance with another feature of the invention, referring to FIG. 17, an axially rotatable pin 130 with a finned end 131 is here shown on the door B. The pin 130 upon rotation when the door is closed catches one of the fins 131 against a bracket 132, here shown on the cabinet C. Placement of at least one of such pin and bracket arrangements prevents prying of the door at a corner. With the bayonet locking means adjacent an opposite corner, both door opening corners are protected.

What is claimed is:

1. A locking system for a cabinet having a body and a door hingedly connected to the cabinet body and having an open position and a closed position, the movement of the door being unpowered and thus requiring manual opening and closing, the locking system comprising:

a pair of latching components comprising a receiver unit and a movable latch element, the receiver unit being affixed to one of the unpowered cabinet door and the cabinet body and the movable latch element being affixed to the other of the unpowered cabinet door and the cabinet body;

a motor mechanically connected to said movable latch element and being adapted to selectively latch and unlatch the unpowered door of the cabinet; and, a controller for operating the motor wherein:

the motor operates to unlatch the door to allow manual opening of the door upon the controller receiving an access control signal and an indication that an unlatching process is incomplete; and, the motor operates to latch the door to prevent manual opening of the door upon the controller receiving an indication that the latching components have been joined together and an indication that the latching process is incomplete.

2. A locking system for a cabinet having a body and a door hingedly connected to the cabinet body and having an open position and a closed position, the movement of the door being unpowered and thus requiring manual opening and closing, the locking system comprising:

a pair of latching components comprising a receiver unit and a movable latch element, the receiver unit being affixed to one of the cabinet body and cabinet door and the movable latch element being affixed to the other of the cabinet body and cabinet door;

a motor mechanically connected to said movable latch element, the motor being adapted to latch and unlatch the door to the cabinet; and, a controller that controls operation of the motor wherein:

the motor operates to unlatch the door upon the controller receiving an access control signal and an indication that an unlatching process is incomplete; and, the motor operates to latch the door upon the latch components being joined together and, in response to closure of the door, an indication that the latching process is incomplete.

3. A locking system for a cabinet having a cabinet body and a door hingedly connected to the cabinet body, the movement of the door being unpowered and thus requiring manual opening and closing, the system comprising:

a pair of latching components comprising a receiver unit and a movable latch element, the receiver unit being affixed to one of the cabinet body and door, and the movable latch element being affixed to the other of the cabinet body and door;

a motor connected via one or more gears to said movable latch element and being adapted to latch and unlatch the door from the cabinet body; and, a controller that controls operation of the motor wherein:

the motor operates to unlatch the door upon the controller receiving an access control signal and an indication that an unlatching process is incomplete; and, the motor operates to latch the door upon the controller receiving an access control signal, and an indication that the latching process is incomplete.

4. A locking system for a cabinet having a cabinet body and a door hingedly connected to the cabinet body, the movement of the door being unpowered and thus requiring manual opening and closing, the system comprising:

a receiver unit and a movable latch element, the receiver unit being affixed to one of the cabinet body and door, and the movable latch element being affixed to the other of the cabinet body and door;

a motor coupled by at least one gear to the movable latch element and being adapted to latch and unlatch the door to the cabinet; and, a controller that controls operation of the motor wherein:

the door is unlatched upon the controller receiving an access control signal and an indication that an unlatching process is incomplete;

the door is unlatched upon the controller receiving at least one detection signal during a latching process; and, the door is latched upon the controller receiving an indication that the receiver unit and the latch element have been joined together and an access control signal.

5. A locking system for a cabinet having a cabinet body and a door hingedly connected to the cabinet body, the movement of the door being unpowered and thus requiring manual opening and closing, the system comprising:

a receiver unit and a movable latch element, the receiver unit being affixed to one of the cabinet body and door, and the movable latch element being affixed to the other of the cabinet body and door;

a motor connected by at least one gear to said movable latch element and being adapted to latch and unlatch the door;

a controller that operates the motor wherein:

the door is unlatched upon the controller receiving one of either an access control signal or at least one detection signal during a latching process;

the door is latched upon the controller receiving an indication that the receiver unit and the movable latch element have been joined together whereby the movable latch element is actuated or advanced by the motor to move in a first plane or longitudinally between the unlatched position to the latched position and exerting a force in a second plane or radially such that the door is urged toward the cabinet.

6. An apparatus comprising:

a cabinet defining an interior region sized to receive objects;

a door hingedly connected to the cabinet, the movement of the door being unpowered such that the door must be manually moved between an opened position and a closed position for permitting access to the interior region of the cabinet in the open position and blocking access to the interior region of the cabinet in the closed position;

a lock operatively coupled with one of the door and the cabinet comprising a lock member, affixed to one of the cabinet and the door, actuated or retracted by a motor and being adapted to move between a locked position blocking movement of the door from the closed position and an unlocked position permitting movement of the door from the closed position in response to receiving an access signal; and, wherein the lock member is actuated or advanced by the motor to move in a first plane or longitudinally between the unlocked position to the locked position in response to closure of the door and exerting a force in a second plane or radially such that the door is urged toward the cabinet.

7. A locking system for a cabinet having a door hingedly connected to the cabinet with an open position and a closed position, the movement of the door being unpowered such that the door must be manually moved between the open position and the closed position, the locking system comprising:

a pair of latching components comprising a receiver unit and a movable latch element, the receiver unit being affixed to one of the cabinet and door, and the movable latch element being affixed to the other of the cabinet and door;

a motor carried by the door of the cabinet, said motor being mechanically connected to said movable latch element and being adapted to latch and unlatch the door to the cabinet; and, a controller that controls operation of the motor wherein:

the motor operates to unlatch the door and allow manual opening upon the controller receiving an access control signal and an indication that an unlatching process is incomplete;

the motor operates to unlatch the door and allow manual opening upon the controller receiving at least one detection signal during a latching process; and, the motor operates to latch the door and prevent manual opening upon the controller receiving an indication that the latch components have been joined together and an indication that the latching process is incomplete wherein, during the latching process, the movable latch element is actuated or advanced by the motor to move in a first plane or longitudinally between the unlatched position to the latched position and exerting a force in a second plane or radially such that the door is urged toward the cabinet.

8. A locking system for a cabinet having a door hingedly connected to the cabinet with an open position and a closed position, the door movement being unpowered and thus requiring manual opening and closing of the door, the locking system comprising:

a pair of latching components comprising a receiver unit and a movable latch element, the receiver unit being affixed to one of the cabinet and door, and the movable latch element being affixed to the other of the cabinet and door;

a motor carried by the door or the cabinet, said motor being mechanically connected to said movable latch element and being adapted to latch and unlatch the door to the cabinet; and, a controller that controls operation of the motor wherein:

the motor operates to unlatch the door to allow manual opening of the door upon the controller receiving an access control signal; and the motor operates to latch the door to prevent manual opening of the door upon the controller receiving an access control signal and an indication that the latching process is incomplete wherein, during the latching process, the movable latch element is actuated or advanced by the motor to move in a first plane or longitudinally between the unlatched position to the latched position and exerting a force in a second plane or radially such that the door is urged toward the cabinet.

9. A locking system for a cabinet body having a door hingedly connected to the cabinet body with an open position and a closed position, the door being unpowered and thus requiring manual movement between the open and closed positions, the locking system comprising:

a pair of latching components comprising a receiver unit and a movable latch element, the receiver unit being affixed to one of the cabinet body and door, and the movable latch element being affixed to the other of the cabinet body and door;

a motor carried by the door or the cabinet body, said motor being mechanically connected to said bayonet for latching and unlatching the door to the cabinet body;

the motor operates to unlatch the door to allow manual opening of the door upon activation of an access control signal; and, the motor operates to latch the door to prevent manual opening of the door upon receipt of an indication that the latch components have been joined together and an access control signal wherein, during the latching process, the movable latch element is actuated or advanced by the motor to move in a first plane or longitudinally between the unlatched position to the latched position and exerting a force such that the door is urged toward the cabinet.

10. A locking system for a cabinet having a door hingedly connected to the cabinet with an open position and a closed position, the door movement being unpowered and thus requiring manual movement between the open and closed positions, the locking system comprising:

a pair of latching components comprising a receiver unit and a latch element, the receiver unit being affixed to one of the cabinet and door, and the movable latch element being affixed to the other of the cabinet and door;

a motor carried by the door or the cabinet, said motor being mechanically connected to said latch element and being adapted to latch and unlatch the door to the cabinet; and, wherein the motor operates to unlatch the door to allow manual opening of the door upon receipt of an access control signal and an indication that an unlatching process is incomplete;

the motor operates to unlatch the door to allow manual opening of the door upon detection of at least one event during the latching process; and, the motor operates to latch the door to prevent manual opening of the door upon receipt of an indication that the latch components have been joined together and an indication that the latching process is incomplete.

11. A locking system for a cabinet having a door hingedly connected to the cabinet with an open position and a closed position, movement of the door being unpowered, the door thus requiring manual opening and closing, the locking system comprising:

a pair of latching components comprising a receiver unit and a moveable latch element, the receiver unit being affixed to one of the cabinet and door, and the movable latch element being affixed to the other of the cabinet and door;

a motor carried by the door or the cabinet, said motor being mechanically connected to said moveable latch element and being adapted to latch and unlatch the door to the cabinet; and, wherein the motor operates to unlatch the door to allow manual opening of the door upon receipt of an access control signal and an indication that an unlatching process is incomplete; and the motor operates to exert a force to urge the door toward the cabinet upon the latch components being joined together and receipt of an indication that the latching process is incomplete.

12. A locking system for a cabinet having a door hingedly connected to the cabinet with an open position and a closed position, the door being unpowered for movement such that it requires manual opening and closing, the locking system comprising:

a pair of latching components comprising a receiver unit and a moveable latch element, the receiver unit being affixed to one of the cabinet and door, and the movable latch element being affixed to the other of the cabinet and door; and a motor carried by the door or the cabinet, said motor being mechanically connected to said moveable latch element and being adapted to latch and unlatch the door to the cabinet; and, wherein the motor operates to unlatch the door to allow manual opening of the door upon receipt of an access control signal and an indication that an unlatching process is incomplete; and the motor operates to exert a force to urge the door toward the cabinet upon the latch components being joined together and in response to closure of the door.

* * * * *